US008311472B2

(12) United States Patent
Fujiki et al.

(10) Patent No.: US 8,311,472 B2
(45) Date of Patent: Nov. 13, 2012

(54) IMAGE FORMING APPARATUS AND IMAGE FORMING METHOD

(75) Inventors: Ryuji Fujiki, Ebina (JP); Takeshi Kato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 585 days.

(21) Appl. No.: 12/554,465

(22) Filed: Sep. 4, 2009

(65) Prior Publication Data

US 2010/0189448 A1 Jul. 29, 2010

(30) Foreign Application Priority Data

Jan. 28, 2009 (JP) ..... 2009-16967

(51) Int. Cl.
*G03G 15/00* (2006.01)

(52) U.S. Cl. ..... 399/396; 399/394

(58) Field of Classification Search ..... 399/396
See application file for complete search history.

(56) References Cited

U.S. PATENT DOCUMENTS

| | | | | |
|---|---|---|---|---|
| 6,452,147 | B1 * | 9/2002 | Inada | 250/208.1 |
| 6,608,991 | B2 * | 8/2003 | Takada | 399/394 |
| 6,952,557 | B2 * | 10/2005 | Kobayashi | 399/394 |
| 7,197,256 | B2 * | 3/2007 | Nishizaki | 399/66 |
| 7,505,703 | B2 * | 3/2009 | Akita et al. | 399/45 |
| 7,647,015 | B2 * | 1/2010 | Kubota et al. | 399/301 |
| 2007/0264033 | A1 * | 11/2007 | Koshida | 399/16 |
| 2008/0124127 | A1 * | 5/2008 | Inui et al. | 399/165 |
| 2008/0260444 | A1 * | 10/2008 | Ikeda | 399/388 |

FOREIGN PATENT DOCUMENTS

| | | |
|---|---|---|
| JP | 08-286523 | 11/1996 |
| JP | 2001-109218 | 4/2001 |
| JP | 2005-315972 | 11/2005 |

* cited by examiner

*Primary Examiner* — Anthony Nguyen
(74) *Attorney, Agent, or Firm* — Morgan, Lewis & Bockius LLP

(57) ABSTRACT

The image forming apparatus includes: an image holder that is movably provided; a first image forming unit that forms a first image on the image holder; a second image forming unit that forms a second image on the image holder including the first image formed thereon; a transfer portion that transfers, onto a recording medium, the first image and the second image formed on the image holder; a supply unit that transports the recording medium and that supplies the recording medium to the transfer portion; an acquisition unit that acquires information on a position of displacement on the recording medium in a transport direction of the recording medium, the displacement occurring between the first image and the second image transferred onto the recording medium; and an adjustment unit that changes a supply speed of the recording medium at the supply unit on the basis of the information on the position.

10 Claims, 21 Drawing Sheets

IMAGE FORMING APPARATUS AND IMAGE FORMING METHOD

CROSS REFERENCE TO RELATED APPLICATIONS

This application is based on and claims priority under 35 USC §119 from Japanese Patent Application No. 2009-16967 filed Jan. 28, 2009.

BACKGROUND

1. Technical Field

The present invention relates to an image forming apparatus such as a printer or a copy machine, and an image forming method.

2. Related Art

In an image forming apparatus having multiple image forming units, color misregistration occurs sometimes because of displacement of transfer positions which occurs due to a non-uniform rotational speed or the like of photoconductive drums or the like. The color misregistration refers to a case where images do not coincide with one another when the images are superimposed on one another. In this respect, various techniques have been proposed to address this problem.

SUMMARY

According to an aspect of the present invention, there is provided an image forming apparatus including: an image holder that is movably provided; a first image forming unit that forms a first image on the image holder; a second image forming unit that forms a second image on the image holder including the first image formed thereon; a transfer portion that transfers, onto a recording medium, the first image and the second image formed on the image holder; a supply unit that transports the recording medium and that supplies the recording medium to the transfer portion; an acquisition unit that acquires information on a position of displacement on the recording medium in a transport direction of the recording medium, the displacement occurring between the first image and the second image transferred onto the recording medium; and an adjustment unit that changes a supply speed of the recording medium at the supply unit on the basis of the information on the position, the information acquired by the acquisition unit.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

Figure 1:
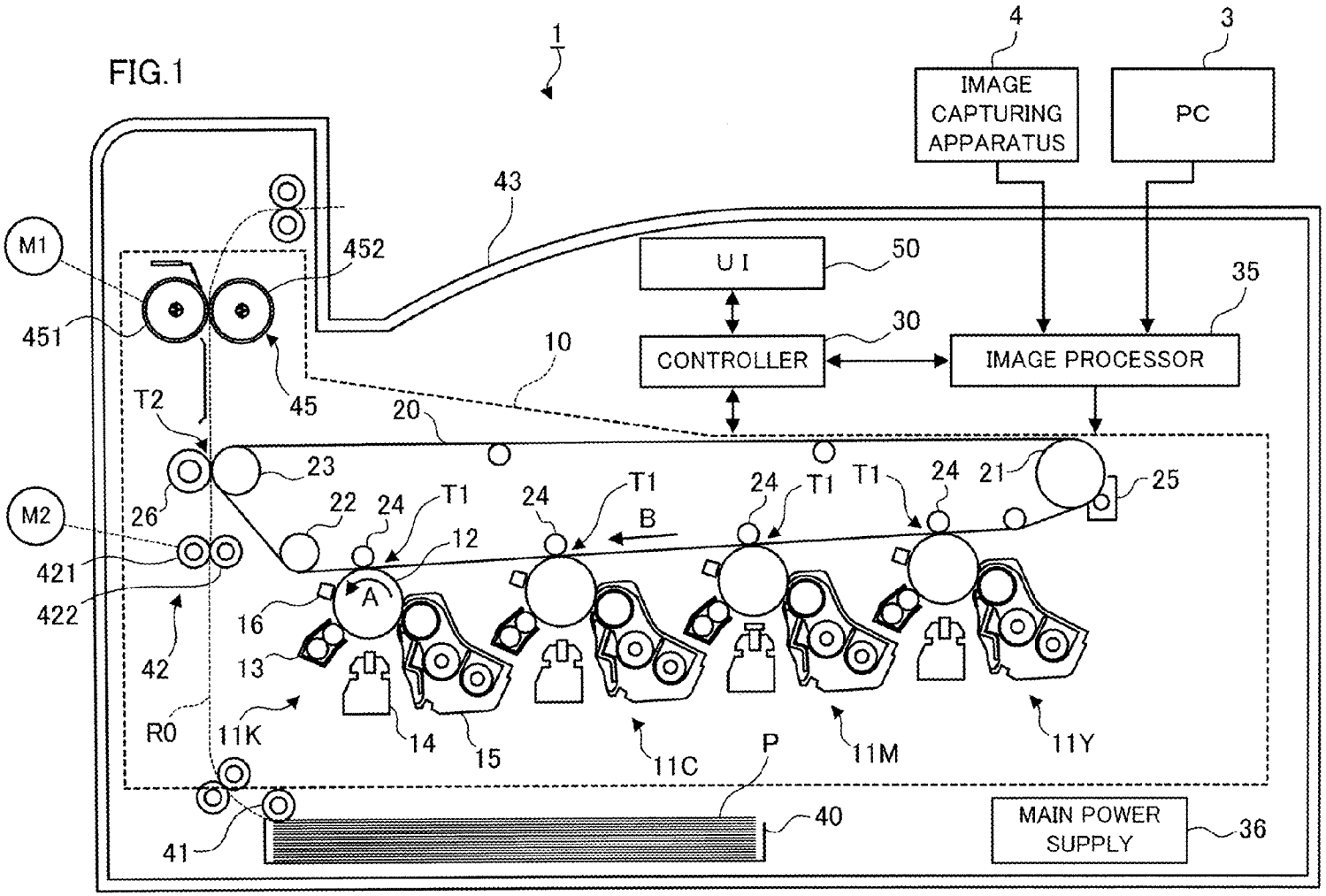
FIG. 1 is a diagram showing an example of an overall configuration of an image forming apparatus to which the exemplary embodiment is applied.

FIG. 1 is a diagram showing an example of an overall configuration of an image forming apparatus 1 to which the exemplary embodiment is applied. The image forming apparatus 1 shown in FIG. 1 is a so-called tandem-type color printer, and includes: an image-formation process unit 10 that performs image formation in accordance with color image data; a controller 30 (as an example of an acquisition unit and an adjustment unit) that controls operations of the entire image forming apparatus 1; an image processor 35 that is connected to an external device such as a personal computer (PC) 3 or an image capturing apparatus 4, and that performs image processing on image data received from the external device; and a main power supply 36 that supplies power to each component. The image forming apparatus 1 also includes a UI 50 that is configured of a display panel or the like and that receives information from a user and also displays information for the user.

The image-formation process unit 10 includes four image forming units 11Y, 11M, 11C and 11K (also collectively referred to as an "image forming unit 11") that are arranged side by side at certain intervals along the moving direction of an intermediate transfer belt 20. Each of the image forming units 11 as an example of toner image forming units includes: a photoconductive drum 12 that is rotatably arranged, forms an electrostatic latent image and holds a toner image; a charging device 13 that uniformly charges the surface of the photoconductive drum 12; an LED print head (LPH) 14 that is arranged along an axis direction (first scan direction) of the photoconductive drum 12, and that exposes, on the basis of image data, the surface of the photoconductive drum 12 charged by the charging device 13; a developing device 15 that develops the electrostatic latent image formed on the photoconductive drum 12; and a drum cleaner 16 that cleans the surface of the photoconductive drum 12 after transfer.

In addition, the image forming units 11 respectively form toner images of yellow (Y), magenta (M), cyan (C) and black (K). Note that, these four image forming units 11Y, 11M, 11C and 11K are arranged from the upstream side in the moving direction of a later-described intermediate transfer belt 20 toward the downstream side therein in this order. Moreover, the image forming unit 11Y may be taken as a first image forming unit, for example, and the image forming unit 11K may be taken as a second image forming unit.

Furthermore, the image-formation process unit 10 includes: the intermediate transfer belt 20 as an example of an image holder onto which multiple layers of color toner images formed on the photoconductive drums 12 of the image forming units 11 are transferred; a drive roll 21 that drives the intermediate transfer belt 20; a tension roll 22 that provides tension to the intermediate transfer belt 20; a backup roll 23 that is provided for secondarily transferring superimposed color toner images onto a sheet P; and a belt cleaner 25 that removes residual toner or the like existing on the intermediate transfer belt 20.

The intermediate transfer belt 20 is wound around the drive roll 21, the tension roll 22, and the backup roll 23 under a tension set in advance. The intermediate transfer belt 20 is also circularly driven at a speed set in advance in a direction of an arrow B by the drive roll 21 rotationally driven by a dedicated drive motor excellent in constant speed property (not shown in the figure). Note that, as a material of the intermediate transfer belt 20, a belt material (rubber or resin) that does not charge up and whose resistance is adjusted is used.

Moreover, the image-formation process unit 10 includes: primary transfer rolls 24 that respectively form primary transfer portions T1 at which the color toner images formed in the respective image forming units 11 are sequentially transferred (primarily transferred) onto the intermediate transfer belt 20; and a secondary transfer roll 26 that collectively transfers (secondarily transferred) the superimposed toner images transferred onto the intermediate transfer belt 20 onto the sheet P which is a recording medium (recording sheet). In addition, the image-formation process unit 10 includes a fixing device 45 (as an example of a fixing unit) that fixes the superimposed toner images having been secondarily transferred, onto the sheet P while transporting the sheet P. Here, the fixing device 45 includes: a fixing roll 451 that is rotationally driven by a first motor M1; and a pressure roll 452 that is arranged to press this fixing roll 451, and that forms a nip portion between itself and the fixing roll 451. The sheet P passes through this nip portion. The fixing device 45 also includes a heater (not shown in the figure) that heats the fixing roll 451.

In the image forming apparatus 1 of the present exemplary embodiment, image data inputted from the PC 3 or the image capturing device 4 is subjected to image processing performed by the image processor 35, and then is supplied to the image forming units 11 via an interface not shown in the figure. Then, in the black (K) image forming unit 11K, for example, the photoconductive drum 12 is uniformly charged by the charging device 13 while rotating in a direction of an arrow A, and then is exposed to light emitted from the LPH 14 on the basis of the image data transmitted from the image processor 35. Thereby, an electrostatic latent image for the black (K) color image is formed on the photoconductive drum 12. Then, the developing device 15 develops the electrostatic latent image formed on the photoconductive drum 12, hence, forming the black (K) color toner image on the photoconductive drum 12. In the same manner, yellow (Y), magenta (M) and cyan (C) color toner images are formed in the image forming units 11Y, 11M and 11C, respectively.

The color toner images formed respectively in the image forming units 11 are sequentially and electrostatically adsorbed onto the intermediate transfer belt 20 moving in the direction of the arrow B with use of the respective primary transfer rolls 24, and then a composite toner image obtained by superimposing the color toner images on one another is formed on the intermediate transfer belt 20. Then, the composite toner image on the intermediate transfer belt 20 is transported along with the moving of the intermediate transfer belt 20 to an area (secondary transfer portion T2) at which the secondary transfer roll 26 is arranged.

Meanwhile, the sheet P is taken out from a sheet supplying unit 40 by a pickup roll 41 for feeding sheets. Then, this sheet P is transported to a position of the registration rolls 42 that regulate the position of the sheet P along a transport path R0. Then, the sheet P is transported toward the secondary transfer portion T2 by the registration rolls 42 in synchronization with a timing at which the composite toner image is transported to the secondary transfer portion T2. At the secondary transfer portion T2, the composite toner image is electrostatically transferred (secondarily transferred) onto the sheet P at once by action of a transfer electric field formed between the backup roll 23 and the secondary transfer roll 26 having the secondary transfer bias voltage applied thereto. Note that, the registration rolls 42 as examples of a supply unit are configured of a drive registration roll 421 that is rotationally driven by a second motor M2, and a driven registration roll 422 that is arranged to press the drive registration roll 421 and that follows and rotates with the drive registration roll 421. Then, the registration rolls 42 transport the sheet P while holding the sheet P between the drive registration roll 421 and the driven registration roll 422, and supplies the sheet P to the secondary transfer portion T2.

Thereafter, the sheet P having the composite toner image electrostatically transferred thereonto is peeled from the intermediate transfer belt 20 and then transported to the fixing device 45. The composite toner image on the sheet P transported to the fixing device 45 is subjected to fixing processing with heat and pressure by the fixing device 45, and is thereby fixed onto the sheet P. Then, the sheet P having the fixed image formed thereon is transported to an output sheet stack unit 43 provided at an output unit of the image forming apparatus 1. Meanwhile, the toner (transfer residual toner) attached to the intermediate transfer belt 20 after the secondary transfer is removed from the surface of the intermediate transfer belt 20 by the belt cleaner 25 after the secondary transfer finishes, and the intermediate transfer belt 20 is thus made ready for the next image forming cycle. In this way, the image formation in the image forming apparatus 1 is repeatedly performed for a designated number of sheets.

Incidentally, in the above-described image forming apparatus 1, that is, in the so-called tandem type image forming apparatus 1, non-uniform rotation of the photoconductive drums 12, non-uniform movement of the intermediate transfer belt 20 or the like caused by machine accuracy or the like occurs, hence causing color misregistration to appear on the sheet P when the color toner images are superimposed and then transferred onto the sheet P in some cases.

In order to address this problem and to make a multi color print with high image quality, a write-start position control technique for correcting color misregistration is necessary. As an example of such a write-start position control technique, there is known a technique in which toner images of specific patterns are formed on the intermediate transfer belt 20 or the like, which patterns are then detected by use of a CCD camera or the like, and the amount of color misregistration is calculated from the result of detection of the patterns, for example (refer to Japanese Patent Application Laid Open Publication No. 8-286523). In this technique, correction amount data are sent to each correction system, and adjustment is made.

Moreover, the types of color misregistration include one that occurs when the toner images superimposed on the intermediate transfer belt 20 and the like are recorded (transferred) onto the sheet P. Here, this type of color misregistration is not judged until the image data are actually outputted onto the sheet P.

In order to cope with this type of color misregistration, there have been proposed various methods in which patterns that make color misregistration easily visible are recorded on the sheet P, and then, the amount of color misregistration on the outputted sheet P is measured. For example, the following methods are proposed: a method in which groups of mutually different color lines are shifted in each area in a stepwise manner, and a correction amount is determined depending on a position where the different colors overlap with each other (Japanese Patent Application Laid Open Publication No. 2001-109218); a method in which an aspect of overlapped patterns changes depending on the amount of the color misregistration, thereby causing a correction value to emerge (Japanese Patent Application Laid Open Publication No. 2005-315972), or a method in which the amount of color misregistration is judged by use of cross shaped patterns having different colors.

Furthermore, color misregistration also occurs due to a change in the moving speed of the intermediate transfer belt 20 in some cases. For example, in the image forming apparatus 1 of the present exemplary embodiment, which employs an intermediate transfer belt system, the sheet P is sent to the secondary transfer portion T2 by the registration rolls 42. At the secondary transfer portion T2, the sheet P is then held between the intermediate transfer belt 20 and the secondary transfer roll 26. At this time, when the transport speed of the sheet P transported by the registration rolls 42 is lower than the moving speed of the intermediate transfer belt 20, the sheet P is pulled by the registration rolls 42. As a result of this, the moving speed of the intermediate transfer belt 20 decreases to a speed less than a moving speed set in advance. Then, in a case where a toner image is formed on the intermediate transfer belt 20 at this time, the position at which this toner image is formed is displaced, hence causing color misregistration.

In addition, when the transport speed of the sheet P transported by the registration rolls 42 is higher than the moving speed of the intermediate transfer belt 20, the registration rolls 42 pushes the sheet P toward the intermediate transfer belt 20. As a result, the moving speed of the intermediate transfer belt 20 becomes higher. Moreover, when the bottom end of this sheet P passes through the registration rolls 42, the force to push the sheet P no longer exists, so that the moving speed of the intermediate transfer belt 20 decreases. As a result, color misregistration occurs in this case as well.

Specifically, in a case where the transport speed of the sheet P is high or low as compared with the moving speed of the intermediate transfer belt 20, the force to pull or to push the sheet P is brought into effect, thereby causing a change in the moving speed of the intermediate transfer belt 20. As a result, color misregistration occurs as described above. In particular, image forming apparatuses in recent years have been made to be much smaller in size, so that the distance between the secondary transfer portion T2 and the registration rolls 42 tends to be shorter in this case. The change in the moving speed of the intermediate transfer belt 20 more likely occurs in this case, hence more likely causing color misregistration. Note that, the larger the basis weight of the sheet P and the harder the stiffness of the sheet P, the more likely the change in the moving speed of the intermediate transfer belt 20 occurs.

Here, color misregistration is prevented by selecting an optimum value for the rotation speed of the registration rolls 42. However, in a case where the dimensions of the registration rolls 42 vary for example, the rotation speed of the registration rolls 42 changes. In addition, the rotation speed of the registration rolls 42 sometimes changes due to a change with the passage of time or depending on use environment.

In this respect, the rotation speed of the registration rolls 42 is measured by an encoder or the like, and the speed of the registration rolls 42 may be controlled on the basis of the result of the measurement, for example. However, in this case, the costs and the size of the apparatus increase. Note that, in the techniques using the aforementioned test patterns, which have been proposed heretofore, this type of color misregistration partially occurring on the sheet P is not considered as a target color misregistration. Accordingly, whether or not the rotation speed of the registration rolls 42 is optimum may not be determined by the techniques. In addition, there is a concern that detection of the amount of correction, which is the original purpose, may not be performed.

Here, descriptions will be given of the color misregistration attributable to the rotation speed of the registration rolls 42.

FIGS. 2A to 2D, 3A to 3C, 4, 5A to 5D, 6A and 6B, 7A and 7B, and 8 are diagrams for explaining the color misregistration attributable to the rotation speed of the registration rolls 42.

Firstly, with reference to FIGS. 2A to 2D, 3A to 3C, and 4, descriptions will be given of color misregistration that occurs when the rotation speed of the registration rolls 42 is lower than a speed set in advance.

Note that, in FIGS. 2A to 2D, and 3A to 3C, and later-described 5A to 5D, 6A and 6B, 7A and 7B, and the like, the intermediate transfer belt 20, the secondary transfer roll 26 and the registration rolls 42 are shown in a simplified manner. In addition, in these drawings, for the purpose of making the illustrations easily viewable, an illustration of the image forming unit 11M is omitted. Moreover, only the photoconductive drums 12 are illustrated without illustrating the entire image forming units 11Y, 11C, and 11K. In addition, the photoconductive drums 12 in the image forming units 11Y, 11C, and 11K are denoted by reference numerals 12Y, 12C and 12K, respectively. Furthermore, for the purpose of making the illustrations easily viewable, the amount of displacement of a position between the color toner images is shown larger than the amount of displacement of a position that actually occurs.

Figure 2A:
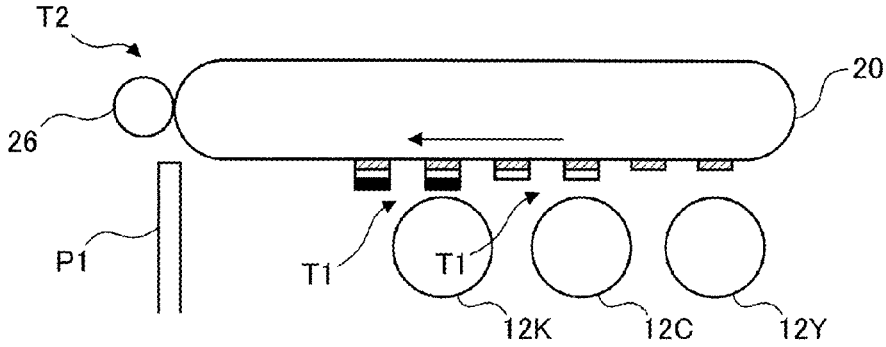
FIGS. 2A to 2D are diagrams for explaining the color misregistration attributable to the rotation speed of the registration rolls.
Figure 2B:
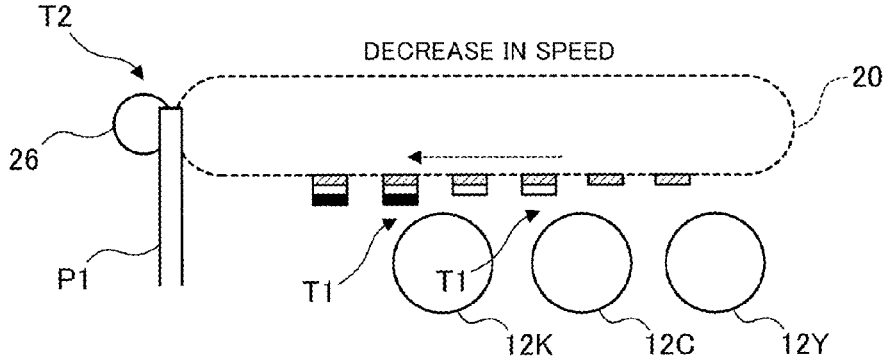

Here, FIG. 2A shows a state before a first sheet P1 enters the secondary transfer portion T2. In this state, the composite toner image is formed on the intermediate transfer belt 20 without having any color misregistration. Then, as shown in FIG. 2B, when the sheet P1 enters the secondary transfer portion T2, a state where the sheet P1 is pulled occurs because the transport speed of the sheet P1 transported by the registration rolls 42 is lower than the moving speed of the intermediate transfer belt 20. As a result, the moving speed of the intermediate transfer belt 20 decreases because of this sheet P1. Note that, the decrease in the moving speed of the intermediate transfer belt 20 is shown by a broken line in FIG. 2B.

Figure 2C:
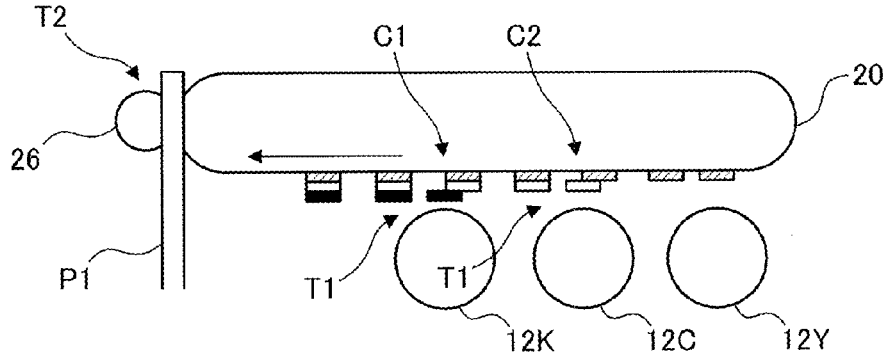

Thereafter, as shown in a solid line in FIG. 2C, the moving speed of the intermediate transfer belt 20 returns to the speed set in advance. However, the toner images influenced by the decrease in the speed of the intermediate transfer belt 20 arrive at the respective primary transfer portions T1 with delay. As a result, as shown by an arrow C1 in FIG. 2C, the black toner image is positioned at the downstream side in the moving direction of the intermediate transfer belt 20 as compared to the cyan toner image and the like, hence causing color misregistration. In addition, as shown by an arrow C2 in FIG. 2C, the cyan toner image is positioned at the downstream side in the moving direction of the intermediate transfer belt 20 as compared to the yellow toner image, hence causing color misregistration.

Figure 2D:
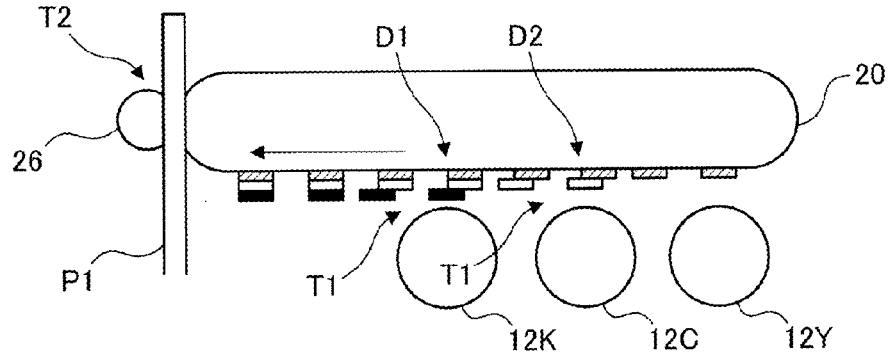

Thereafter, as shown in FIG. 2D, the toner images are further transferred from the photoconductive drums 12K and 12C. However, as shown by an arrow D1 of FIG. 2D, color misregistration occurs between the black toner image transferred from the photoconductive drum 12K and the toner images (yellow and cyan toner images) influenced by the decrease in the speed of the intermediate transfer belt 20. Moreover, as shown by an arrow D2, color misregistration occurs between the cyan toner image transferred from the photoconductive drum 12C and the toner image (yellow toner image) influenced by the decrease in the speed of the intermediate transfer belt 20.

Figure 3A:
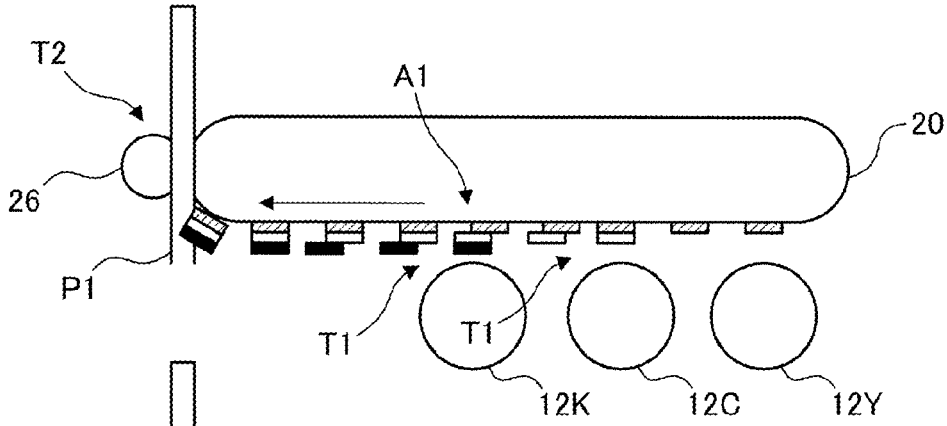
FIGS. 3A to 3C are diagrams for explaining the color misregistration attributable to the rotation speed of the registration rolls.
Figure 3B:
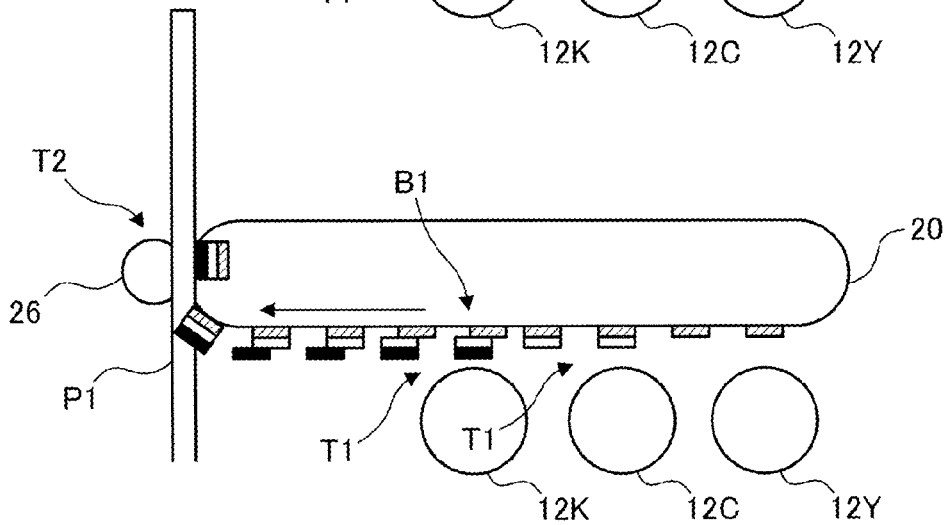

Then, the intermediate transfer belt 20 further moves and becomes in a state shown in FIG. 3A. As shown by an arrow A1 in FIG. 3A as well, color misregistration occurs between the black toner image transferred from the photoconductive drum 12K and the toner image (yellow toner image) influenced by the decrease in the speed of the intermediate transfer belt 20. Moreover, the intermediate transfer belt 20 further moves and becomes in a state shown in FIG. 3B. As shown by an arrow B1 in FIG. 3B as well, color misregistration occurs between the black toner image transferred from the photoconductive drum 12K and the toner image (yellow toner image) influenced by the decrease in the speed of the intermediate transfer belt 20.

Figure 3C:
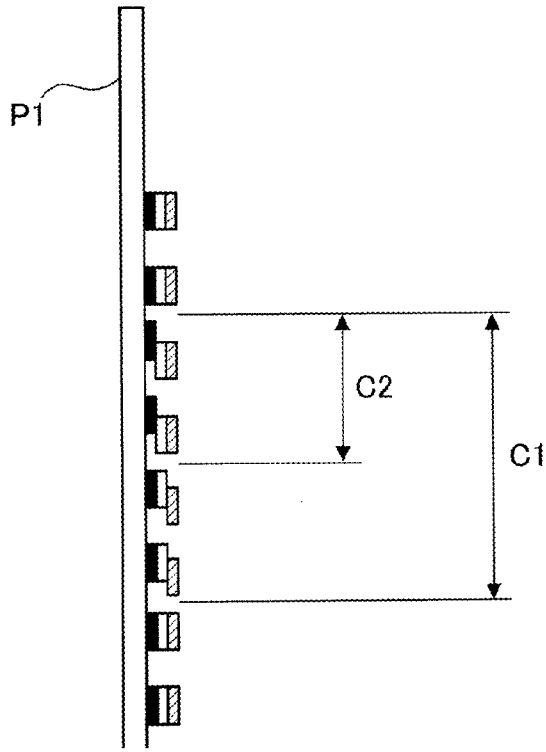

Here, FIG. 3C shows toner images transferred onto the sheet P1. Because of the reasons described above, color misregistration (displacement of positions) occurs between toner images. As shown in FIG. 3C, the color misregistration occurs on the center portion, in the transport direction, of the sheet P1.

In addition, when the speed of the intermediate transfer belt 20 decreases, the amount of influence given to the yellow toner image by the decrease in the speed is larger than that given to the cyan toner image. With reference to FIG. 2B, when the decrease in the speed occurs, the yellow toner images positioned between the photoconductive drums 12K and 12Y are influenced by the decrease in the speed. Meanwhile, the cyan toner images positioned between the photoconductive drums 12K and 12C are influenced by the decrease in the speed. Here, since the photoconductive drum 12Y is positioned more apart from the photoconductive drum 12K than the photoconductive drum 12C, a larger amount of influence is given to the yellow toner images by the decrease in the speed of the intermediate transfer belt 20.

For this reason, in the present exemplary embodiment, the area in which color misregistration occurs between the black toner image and the yellow toner image (refer to C1 in FIG. 3C) is larger than the area in which color misregistration occurs between the black toner image and the cyan toner image (refer to C2 in FIG. 3C). Additionally, in the image forming apparatus 1 of the present exemplary embodiment, the area in which color misregistration occurs between the toner image (black toner image) transferred onto the intermediate transfer belt 20 from the image forming unit 11K positioned at the most downstream side and the toner image (yellow toner image) transferred onto the intermediate transfer belt 20 from the image forming unit 11Y positioned at the most upstream side is the largest. To be more specific, the area in which color misregistration occurs becomes the largest in a case where the image forming units 11K and 11Y which are positioned most apart from each other are used.

As detailed descriptions will be given later, in the present exemplary embodiment, an yellow pattern image PY and a black pattern image PK are formed on a sheet P, and color misregistration that occurs between the yellow pattern image PY and the black pattern image PK is used for judging whether the rotation speed of the registration rolls 42 is high or low. Here, in a case where the black toner image and the yellow toner image are used, the area in which color misregistration occur becomes larger, as mentioned above. As a result of this, visibility in judging whether the rotation speed of the registration rolls 42 is high or low is enhanced.

Figure 4:
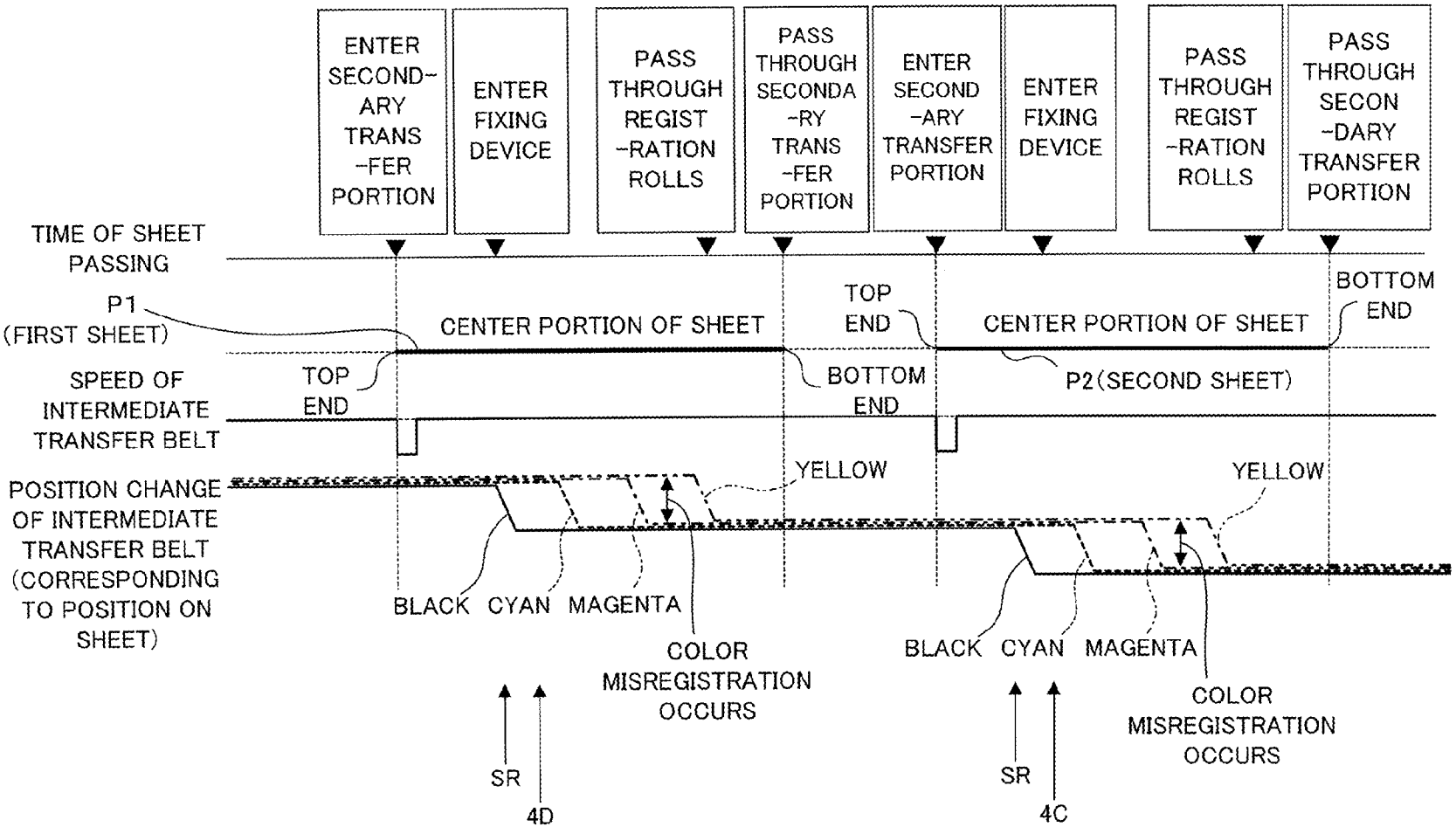
FIG. 4 is a diagram for explaining the color misregistration attributable to the rotation speed of the registration rolls.

Here, FIG. 4 is a diagram showing a summary of the states of color misregistration occurring when the rotation speed of the registration rolls 42 is lower than a speed set in advance.

As shown in FIG. 4, when the top end of the first sheet P1 enters the secondary transfer portion T2, the moving speed of the intermediate transfer belt 20 temporarily deceases. Due to this decrease in the speed, color misregistration in which the black toner image is shifted to a position closer to the top end of the sheet than the other color toner images (cyan, magenta and yellow) occurs at the top end side of the sheet in the center portion of the sheet P1. Moreover, color misregistration in which the black and cyan toner images are shifted to positions closer to the top end side of the sheet than the other color toner images (magenta and yellow) occurs at the center of the center portion of the sheet P1.

Moreover, color misregistration in which the black, cyan and magenta toner images are shifted to positions closer to the top end of the sheet than the other color toner image (yellow) occurs at the bottom end side of the sheet in the center portion of the sheet P1. In addition, when the top end of a second sheet P2 enters the secondary transfer portion T2, the moving speed of the intermediate transfer belt 20 temporarily decreases, and the same color misregistration as those described in the case of the first sheet P1 occur. Note that, as shown in FIG. 4, the area in which the color misregistration occurs between the black and yellow toner images is the largest.

Next, with reference to FIGS. 5A to 5D, 6A and 6B, 7A and 7B, and 8, descriptions will be given of color misregistration occurring when the rotation speed of the registration rolls 42 is higher than a speed set in advance.

Figure 5A:
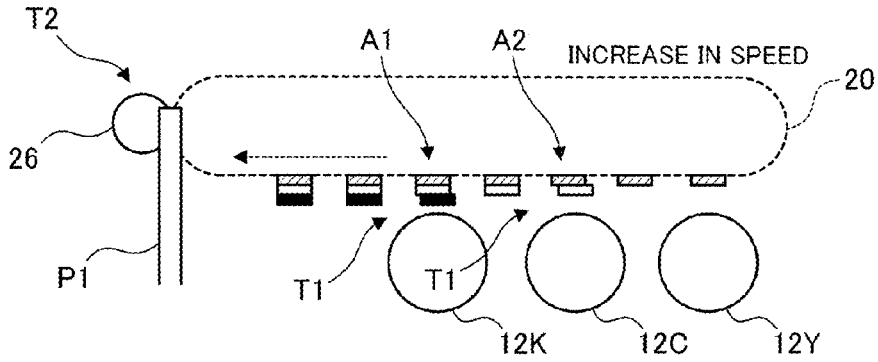
FIGS. 5A to 5D are diagrams for explaining the color misregistration attributable to the rotation speed of the registration rolls.

As shown in FIG. 5A, when the top end of the first sheet P1 enters the secondary transfer portion T2, the registration rolls 42 (not shown in the figure) start to push the sheet P1. Thereby, the moving speed of the intermediate transfer belt 20 increases as shown by a broken line in FIG. 5A. Because of this increase in the speed, the color toner images on the intermediate transfer belt 20 move to positions at the downstream side in the moving direction than originally planned positions. As a result, as shown by an arrow A1, displacement of a position occurs between the black toner image transferred from the photoconductive drum 12K and the toner images (yellow and cyan toner images) influenced by the increase in the speed of the intermediate transfer belt 20. In addition, as shown by an arrow A2, displacement of a position occurs between the cyan toner image transferred from the photoconductive drum 12C and the toner image (yellow toner image) influenced by the increase in the speed of the intermediate transfer belt 20.

Figure 5B:
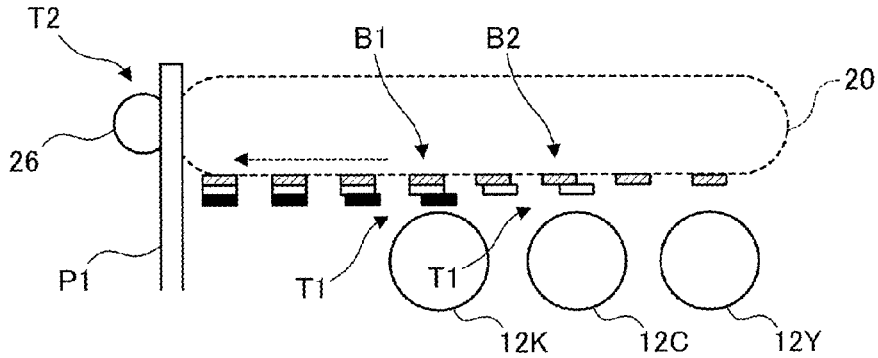
Figure 5C:
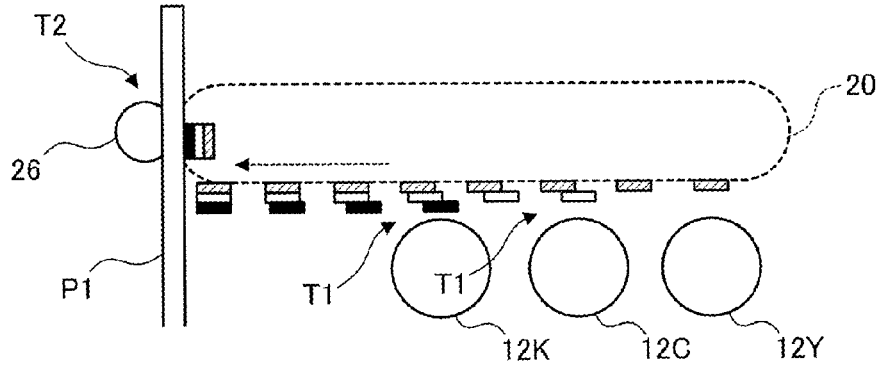
Figure 5D:
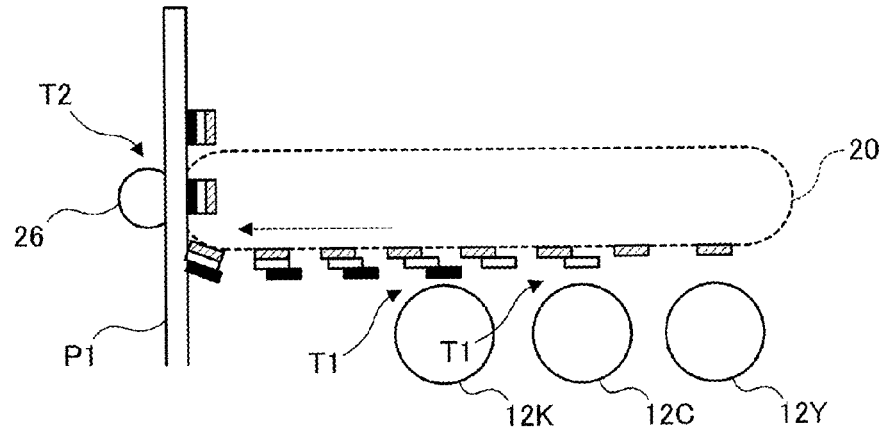
Figure 6A:
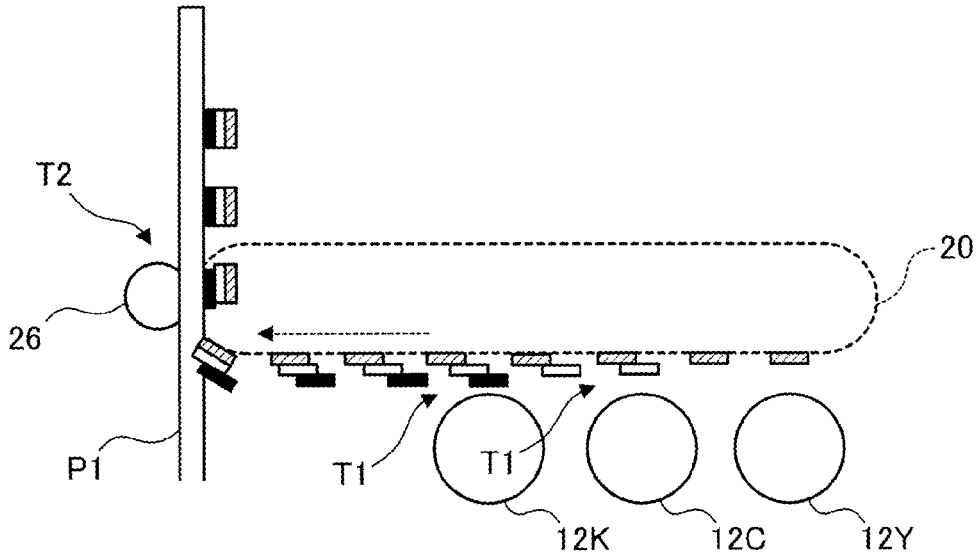
FIGS. 6A and 6B are diagrams for explaining the color misregistration attributable to the rotation speed of the registration rolls.
Figure 6B:
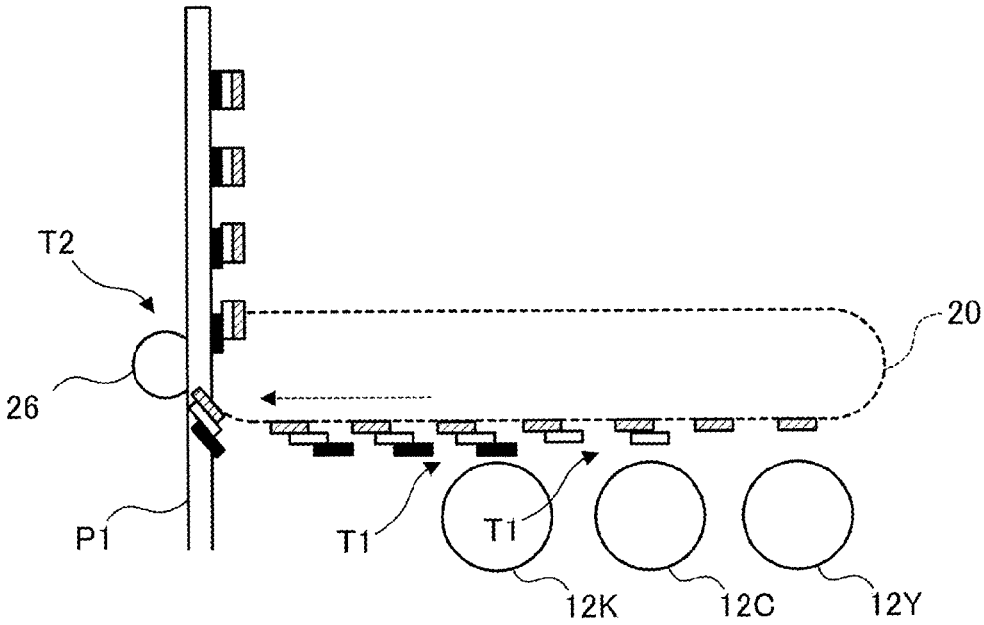

Thereafter, as shown in FIG. 5B, the intermediate transfer belt 20 further moves at the increased speed, and as shown by an arrow B1 in FIG. 5B, displacement of a position occurs between the black toner image transferred from the photoconductive drum 12K and the toner images (yellow and cyan toner images) influenced by the increase in the speed of the intermediate transfer belt 20. In addition, as shown by an arrow B2, displacement of a position occurs between the cyan toner image transferred from the photoconductive drum 12C and the yellow toner image. Thereafter, the intermediate transfer belt 20 further moves at the increased speed, and as the toner images are sequentially transferred from the photoconductive drums 12Y, 12C and 12K, displacement of positions occurs between the respective toner images (refer to FIGS. 5C and D, and FIGS. 6A and B).

Figure 7A:
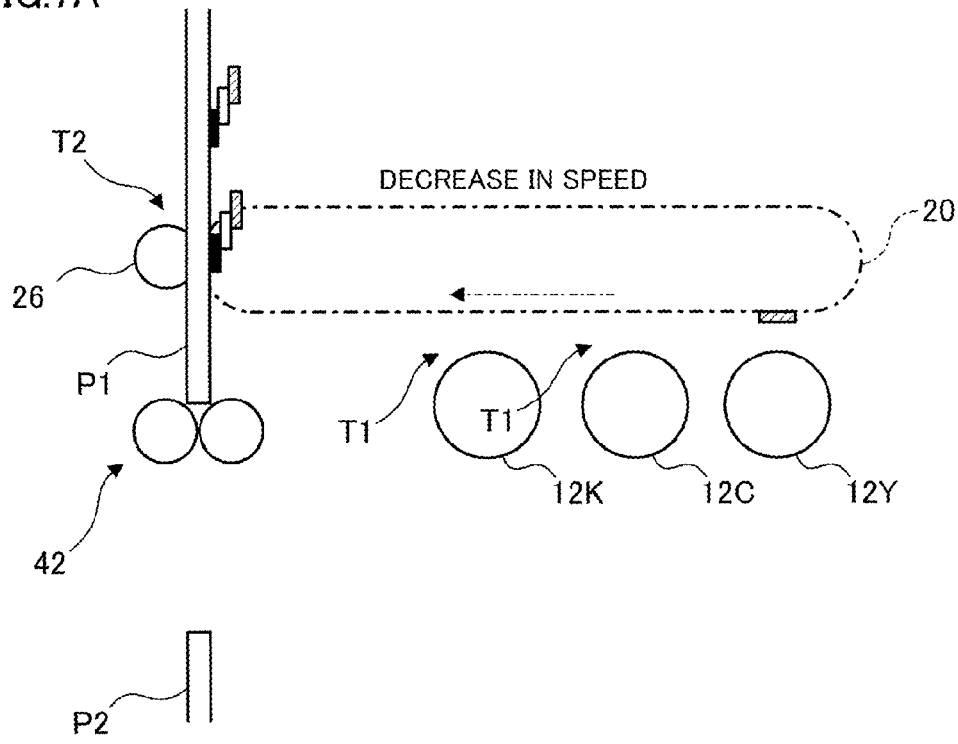
FIGS. 7A and 7B are diagrams for explaining the color misregistration attributable to the rotation speed of the registration rolls.

Incidentally, as shown in FIG. 7A, after the bottom end of the first sheet P1 passes through the registration rolls 42, the force to push this sheet P1 no longer exists, so that the speed of the intermediate transfer belt 20 temporarily decreases as shown by a dot-dash line in FIG. 7A. Then, the decrease in the speed gives an influence to the yellow toner image transferred onto the intermediate transfer belt 20 for the second sheet P2, and causes the timing at which this yellow toner image arrives at the photoconductive drum 12C to delay.

Figure 7B:
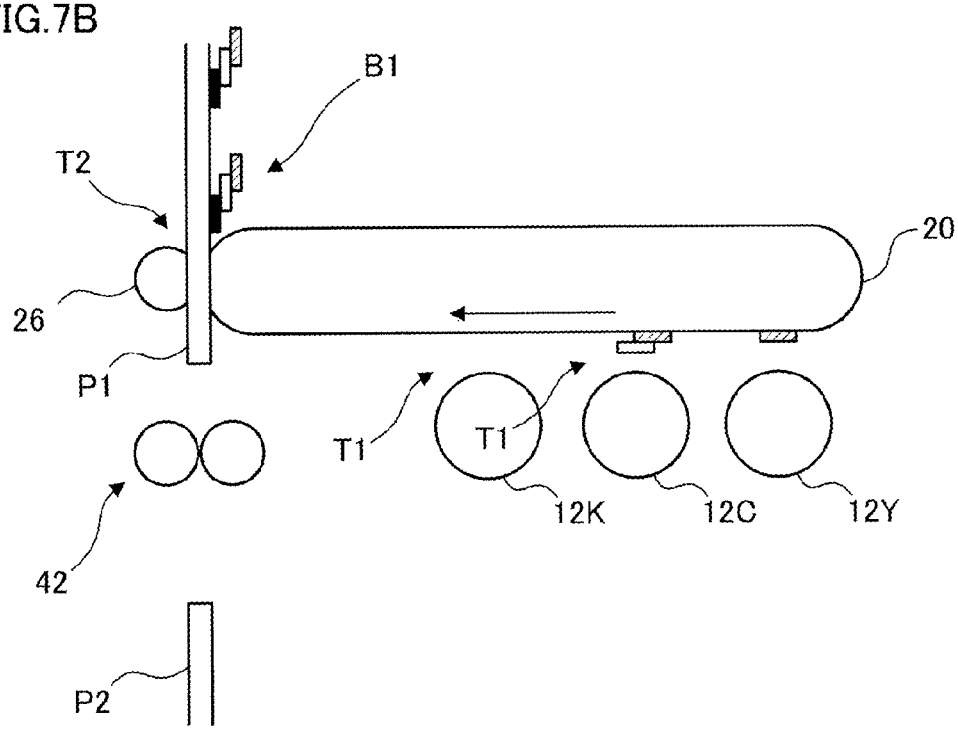

As a result of this, as shown in FIG. 7B, displacement of a position occurs between the cyan toner image transferred from the photoconductive drum 12C and the toner image (yellow toner image) influenced by the decrease in the speed of the intermediate transfer belt 20. Moreover, although the illustration thereof is omitted herein, displacement of a position occurs between the yellow toner image influenced by the decrease in the speed of the intermediate transfer belt 20 and the black toner image to be transferred from the photoconductive drum 12K later.

Figure 8:
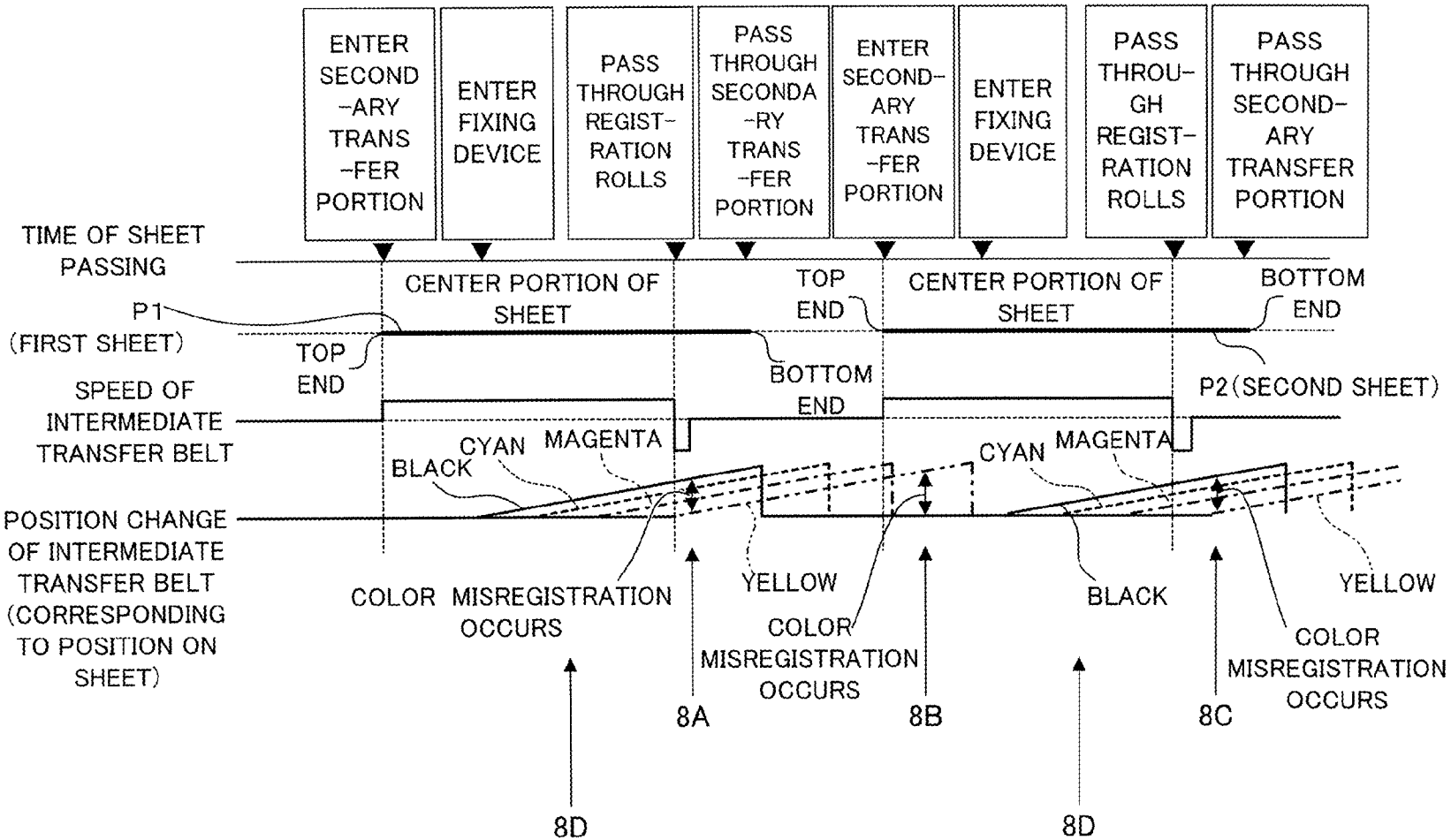
FIG. 8 is a diagram for explaining the color misregistration attributable to the rotation speed of the registration rolls.

FIG. 8 is a diagram showing a summary of the states of color misregistration occurring when the rotation speed of the registration rolls 42 is higher than a speed set in advance.

As shown in FIG. 8, when the top end of the first sheet P1 enters the secondary transfer portion T2, the moving speed of the intermediate transfer belt 20 increases. Because of this increase in the speed, a visually recognizable color misregistration occurs at the bottom end portion (refer to an arrow 8A) of the first sheet P1 due to the displacement of the position between the black and yellow toner images. In addition, a visually recognizable color misregistration occurs at the bottom end portion (refer to an arrow 8C) of the second sheet P2 due to the displacement of the position between the black and yellow toner images.

Furthermore, a visually recognizable color misregistration caused by the displacement of the position between the black and yellow toner images occurs at the top end portion (refer to an arrow 8B) of the second sheet P2 because of the decrease in the speed of the intermediate transfer belt 20, which occurs along with passing of the first sheet P1 through the registration rolls 42.

Note that, at the portion denoted by an arrow 8D in FIG. 8, for example, displacement of a position between the black and yellow toner images occurs. However, the amount of the displacement of the position is small. Thus, a visually recognizable color misregistration does not occur at the portion denoted by the arrow 8D.

Note that, in the displacement of the positions occurring at the bottom end side of the first sheet P1 (refer to the arrow 8A), for example, the amount of the displacement of the position occurring between the black and yellow toner images is larger than that occurring between the black and cyan toner images, as shown by an arrow B1 in FIG. 7B. Additionally, in the displacement of the positions occurring at the bottom end side of the sheet P1, the amount of the displacement of the position occurring between the toner image (black toner image) transferred onto the intermediate transfer belt 20 from the image forming unit 11K arranged at the most downstream side and the toner image (yellow toner image) transferred onto the intermediate transfer belt 20 from the image forming unit 11Y arranged at the most upstream side is the largest.

As described above, when the rotation speed of the registration rolls 42 is high or low, color misregistration between toner images formed on the sheet P occurs. In the present exemplary embodiment, as described below, the rotation speed of the registration rolls 42 is adjusted while attention is paid to this color misregistration.

Here, in the present exemplary embodiment, for the adjustment of the rotation speed of the registration rolls 42, pattern images set in advance are formed for the sheet P.

Figure 9:
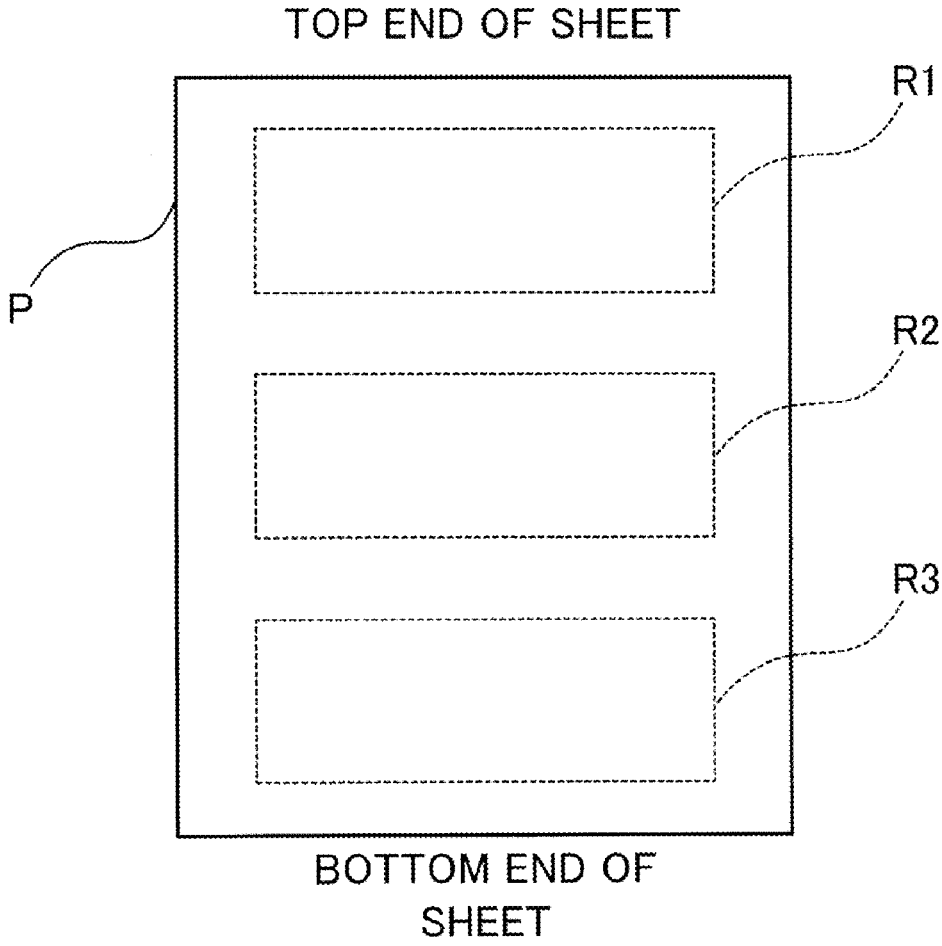
FIG. 9 is a diagram for explaining positions on the sheet P where pattern images are formed.

FIG. 9 is a diagram for explaining positions on the sheet P where pattern images are formed. In the present exemplary embodiment, when the pattern images to be described later are formed, the pattern images are formed at a first region R1, a second region R2 and a third region R3 shown in FIG. 9. Here, each of the first to third regions R1 to R3 is formed into a rectangular shape. Furthermore, the first to third regions R1, R2 and R3 are positioned at the top end portion of the sheet P, the center portion (center portion in the transport direction of the sheet P) of the sheet P and the bottom end portion of the sheet P, respectively.

Subsequently, descriptions will be given of the pattern images formed on the sheet P.

Figure 10C:
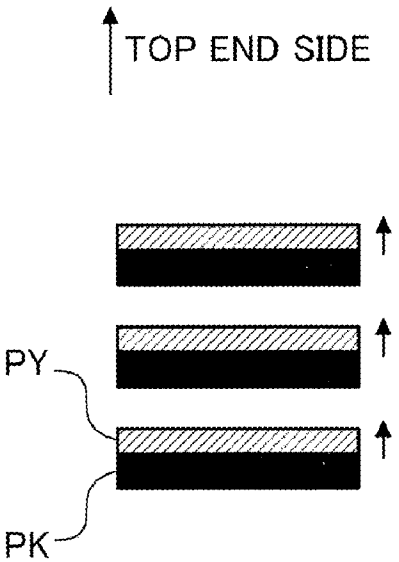
FIGS. 10A to 10C are diagrams for explaining the pattern images.
Figure 10B:
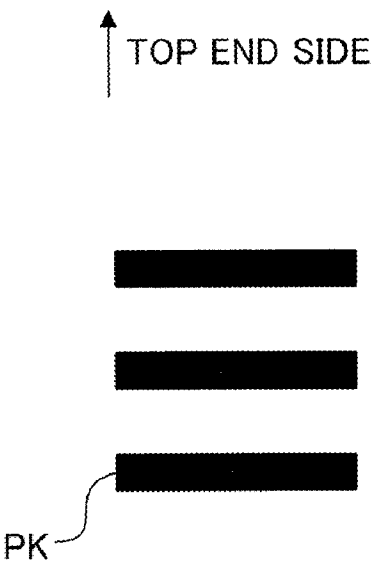
Figure 10A:
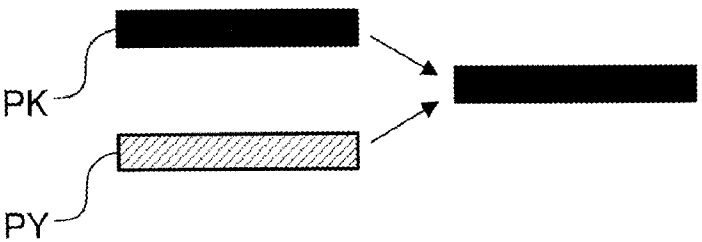

FIGS. 10A to 10C are diagrams for explaining the pattern images.

As shown in FIG. 10A, in the present exemplary embodiment, by use of the yellow image forming unit 11Y, yellow (first color) pattern images PY (first images) are sequentially formed on the moving intermediate transfer belt 20. Moreover, by use of the black image forming unit 11K, black (second color) pattern images PK (second images) are formed on the yellow pattern images PY moving along with the movement of the intermediate transfer belt 20.

In a case where the rotation speed of the registration rolls 42 is different from the rotation speed set in advance, for example, displacement of positions in the transport direction of the sheet P occurs between the pattern images PY and PK as shown in FIG. 10C, and then, yellow becomes recognizable. On the other hand, in a case where the registration rolls 42 rotate at the rotation speed set in advance, no displacement of positions occurs between the pattern images PY and PK as shown in FIG. 10B. Accordingly, yellow does not become recognizable in this case.

Note that, each of the pattern images PY and PK in the present exemplary embodiment is formed into a line shape. In addition, the pattern images PY and PK are arranged in a direction orthogonal to (intersecting with) the transport direction of the sheet P (moving direction of the intermediate transfer belt 20). Moreover, a space is provided between the pattern images PK adjacent to each other. Then, when displacement of a position occurs, the pattern image PY appears in this space. Note that, the shape of the pattern images PY and PK is not limited to a line shape. For example, the pattern image of a dot-shape is employable. However, when the pattern images are formed into a line shape and arranged in the direction orthogonal to the transport direction of the sheet P as in the present exemplary embodiment, the visibility increases as compared with a dot-shape.

Figures 11A, 11B, 11C:
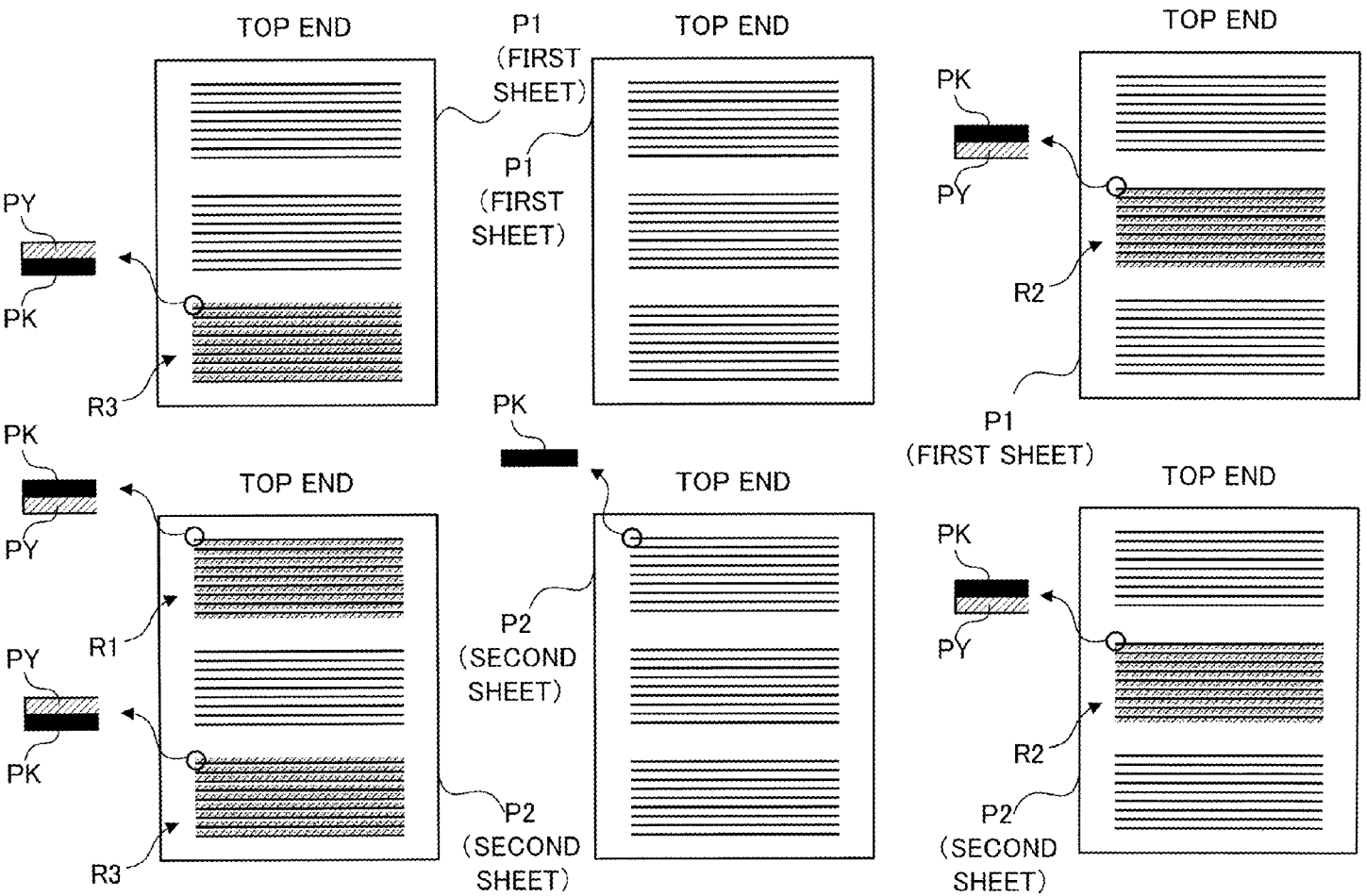
FIGS. 11A to 11C are diagrams showing pattern images formed on the sheets.

Here, FIGS. 11A to 11C are diagrams showing pattern images formed on the sheets P.

When the rotation speed of the registration rolls 42 is high and the registration rolls 42 push the sheet P, the color misregistration in which the positions of the black toner image and the yellow toner image are shifted from each other occurs at the bottom end side of the first sheet P1 as described above. In addition, the color misregistration in which the positions of the black toner image and the yellow toner image are shifted with each other occurs at the top end side and the bottom end side of the second sheet P2. Accordingly, in a case where the aforementioned pattern images PK and PY are formed on the sheet P, the pattern image PY becomes visible on the bottom end side (the third region R3) of the first sheet P1, as shown in FIG. 11A. In addition, the pattern image PY becomes visible on the top end side (the first region R1) and the bottom end side (the third region R3) on the second sheet P2.

Note that, in the color misregistration respectively occurring at the bottom end sides of the first sheet P1 and the second sheet P2, the pattern images PY are positioned closer to the top end of the first sheet P1 and the second sheet P2 than the pattern images PK (also refer to FIG. 7B). Moreover, in the color misregistration occurring at the top end side of the second sheet P2, the pattern image PY is positioned closer to the bottom end of the sheet P2 than the pattern image PK (also refer to FIG. 7B).

On the other hand, in a case where the rotation speed of the registration rolls 42 is low and the sheet P is pulled by the registration rolls 42, the color misregistration in which the positions of the black toner image and the yellow toner image are shifted from each other occurs at the center portion of the sheet P as described above. Specifically, as shown in FIG. 11C, the pattern images PY become visible at the respective center portions (the second regions R2) of the first sheet P1 and the second sheet P2. Here, in these color misregistration, the pattern images PY are positioned closer to the bottom ends of the sheets than the pattern images PK (also refer to FIG. 3C).

Note that, in a case where the transport speed of the sheet P transported by the registration rolls 42 coincides with the moving speed of the intermediate transfer belt 20, the color misregistration between the pattern images PY and the pattern images PK do not occur. Specifically, as shown in FIG. 11B, the pattern images PY are not visible while only the pattern images PK are visible.

Here, the controller 30 in the image forming apparatus 1 of the present exemplary embodiment forms the aforementioned pattern images PY and PK by use of the image forming units 11Y and 11K, respectively, at the aforementioned first to third regions R1 to R3 of the sheet P on the basis of an instruction from a user via the UI 50, for example.

Figure 12:
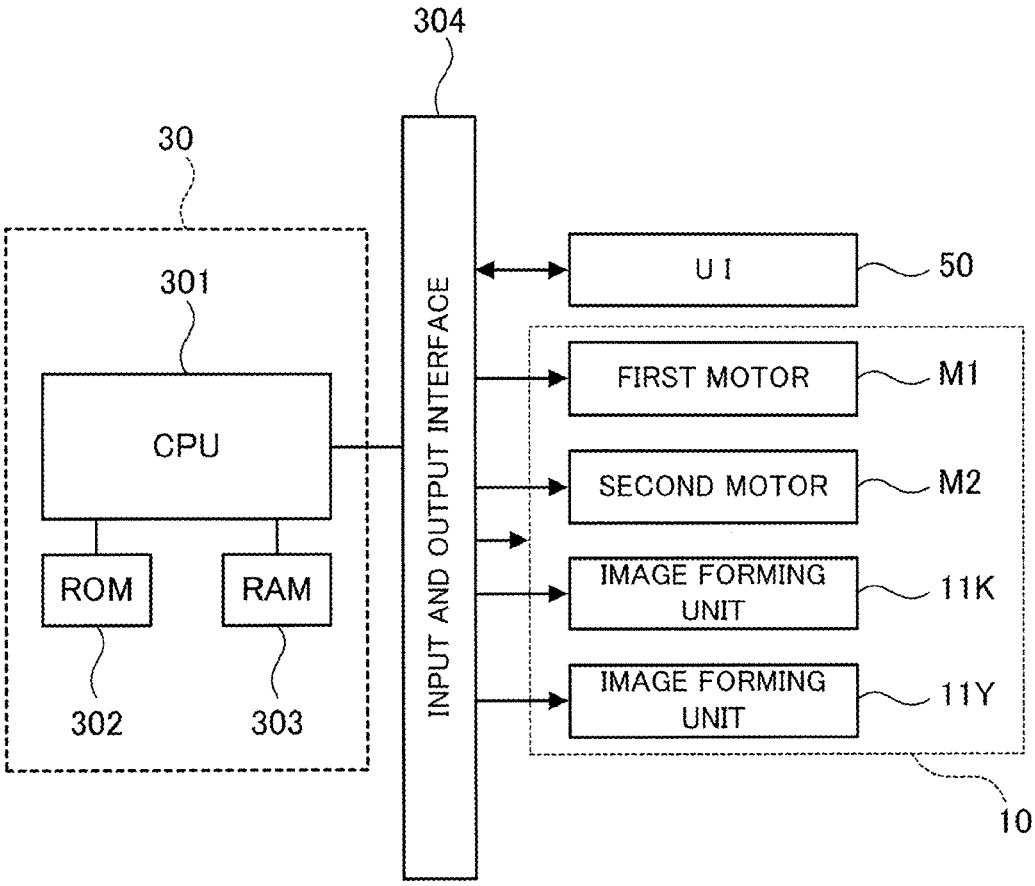
FIG. 12 is a diagram showing control blocks of the controller.

FIG. 12 is a diagram showing control blocks of the controller 30. Note that, in FIG. 12, blocks related to color misregistration between toner images are illustrated.

The controller 30 includes: a central processing unit (CPU) 301; a read only memory (ROM) 302; and a random access memory (RAM) 303. The CPU 301 of the controller 30 executes processing while performing data communication with the RAM 303 in accordance with a program stored in the ROM 302.

The controller 30 receives information from the UI 50 through an input and output interface 304. In addition, the controller 30 displays information on the UI 50 through the input and output interface 304. Moreover, the controller 30 controls a first motor M1 and a second motor M2 (also refer to FIG. 1) provided in the image-formation process unit 10 through the input and output interface 304. Further, the controller 30 controls image forming units 11K and 11Y provided in the image-formation process unit 10. Furthermore, the controller 30 controls a sheet transporting mechanism (not shown in the figure) and the like provided in the image-formation process unit 10.

Next, descriptions will be specifically given of processing performed by the controller 30.

Figure 13:
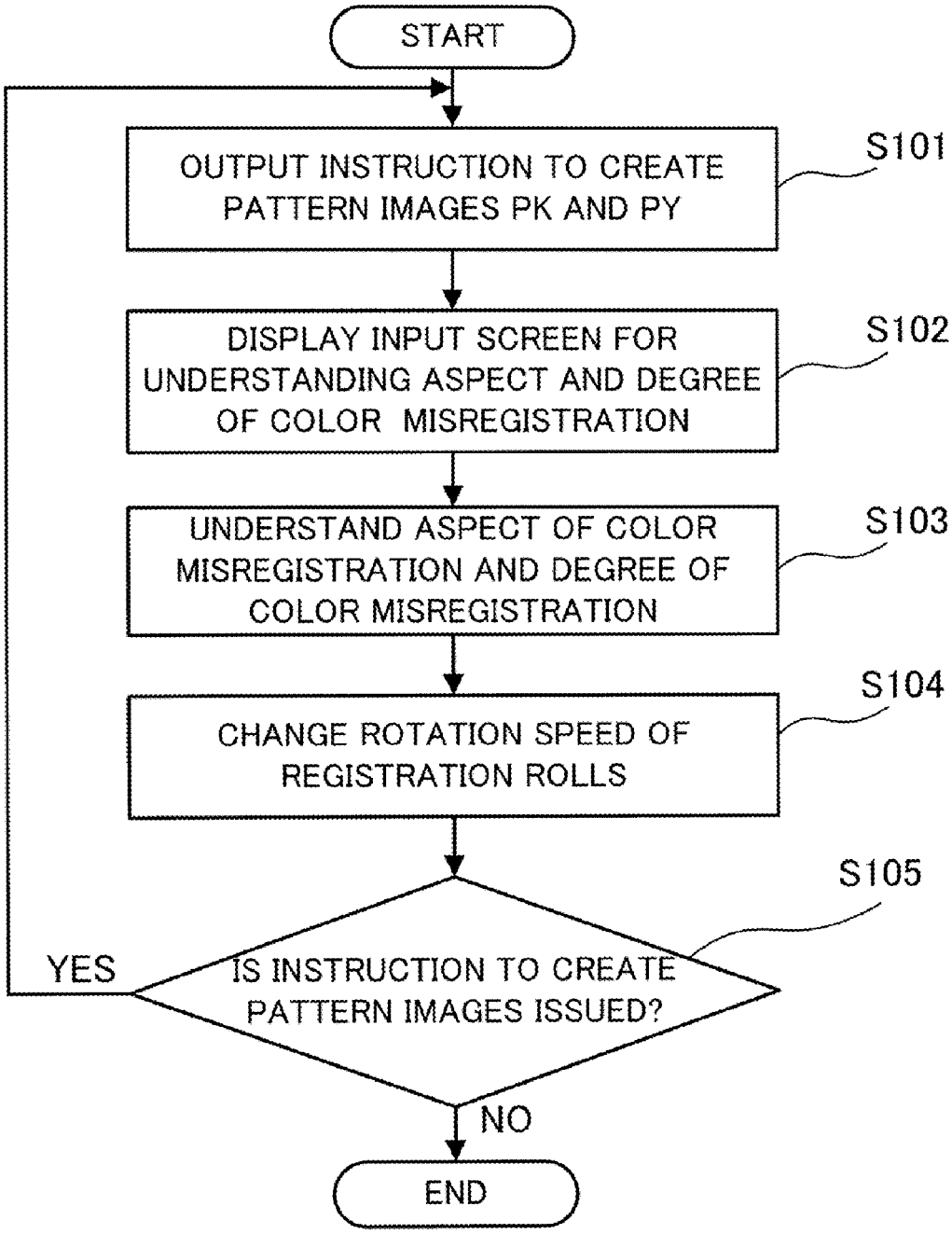
FIG. 13 shows an example of processing executed by the controller for adjusting the rotation speed of the registration rolls.

Here, FIG. 13 shows an example of processing executed by the controller 30 for adjusting the rotation speed of the registration rolls 42.

Firstly, the controller 30 that receives an instruction to create pattern images via the UI 50 outputs an instruction to create the aforementioned pattern images PK and PY to the image-formation processing unit 10 (step 101) Thereby, the first sheet P1 and the second sheet P2 which apply to any one of the three aspects respectively shown in FIGS. 11A to 11C are outputted. Then, the controller 30 displays an input screen for understanding the aspect and degree of the color misregistration on the UI 50 (step 102), and then waits for an input from the user. Then, the controller 30 understands the aspect of the color misregistration (position (area) where the color misregistration occurs) and the degree (amount) of the color misregistration on the basis of the information inputted by the user via the UI 50 (step 103).

To be more specific, in step 102, the controller 30 schematically displays the three aspects shown in FIGS. 11A to 11C on the UI 50, for example, and also displays, on the UI 50, an operation screen for the user to select one of the three aspects, the one applying to each of the outputted first sheet P1 and the second sheet P2. Then, after one of the aspects is selected by the user, the controller 30 displays an operation screen for inputting, by the user, information about the degree of the color misregistration on the UI 50. For example, numeric numbers 1 to 10 corresponding to the degrees of the color misregistration are displayed. Then, the controller 30 understands the degree of the color misregistration on the basis of the numeric number selected by the user.

Thereafter, the controller 30 changes the rotation speed of the registration rolls 42 (the speed at which the sheet P is supplied by the registration rolls 42) on the basis of the aspect of the color misregistration and the degree of the color misregistration understood in step 103 (step 104). For example, when the aspect of the color misregistration is one shown in FIG. 11A, for example, the controller 30 performs a setting to decrease the rotation speed of the registration rolls 42. More specifically, the controller 30 performs a setting to reduce the number of rotations of the second motor M2. Note that, the greater the degree of the color misregistration understood in step 103 is, the greater the number of rotations of the second motor M2 is reduced. Here, when the rotation speed of the registration rolls 42 is changed in the aforementioned manner, the amount of change in the moving speed of the intermediate transfer belt 20 decreases as compared to the case where the rotation speed is not changed. Additionally, when the rotation speed of the registration rolls 42 is changed in the aforementioned manner, the moving speed of the intermediate transfer belt 20 is adjusted.

In addition, when the aspect of the color misregistration is one shown in FIG. 11C, for example, the controller 30 performs a setting to increase the number of rotations of the registration rolls 42. Note that, the greater the degree of the color misregistration understood in step 103 is, the more the number of rotations is increased.

Next, the controller 30 monitors an output from the UI 50, and thereby, determines whether or not an instruction to create pattern images is issued again (step 105). Then, when an instruction to create pattern images is issued again, the controller 30 executes the processing from steps 101 to 104 again. On the other hand, when an instruction to create pattern images is not issued in a certain period of time, the controller 30 stops processing related to the creation of pattern images and returns the contents of the display on the UI 50 to the previous contents.

Note that, in the descriptions given above, the descriptions of the cases where the three aspects shown in FIGS. 11A to 11C are displayed on the UI 50 are provided. In other words, an example of the case where display for the six sheets P is performed is described. However, whether the rotation speed of the registration rolls 42 is high or low may be determined by the second sheet P2. For example, when the state of the second sheet P2 is the state shown in FIG. 11A, the rotation speed of the registration rolls 42 may be determined to be high. Moreover, when the state of the second sheet P2 is the state shown in FIG. 11C, the rotation speed of the registration rolls 42 may be determined to be low. Accordingly, only the display for the second sheet P2 may be performed without the display for the first sheet P1. In addition, the display for the first sheet P1 and the second sheet P2 in FIG. 11B may be omitted. In a case where display for the six sheets are performed as described above, there is a concern that the contents displayed on the UI 50 are hard to view. The visibility on the UI 50 increases by reducing the number of sheets P displayed on the UI 50.

Incidentally, a change in the speed of the photoconductive drums 12Y and 12K occurs in some cases. When such a change in the speed occurs, color misregistration occurs even when the speed of the registration roll 42 is a speed set in advance. Specifically, in some cases, the positions of the pattern images PY and PK are displaced due to a factor other than the registration rolls 42, resulting in a situation where the yellow toner image becomes visible. In this respect, pattern images as shown below may be formed.

Figure 14B:
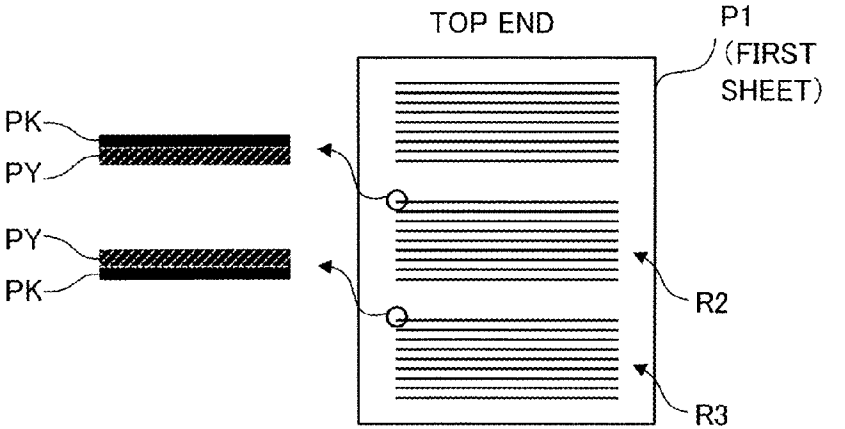
FIGS. 14A to 14C are diagrams showing other forms of the pattern images.
Figure 14B:
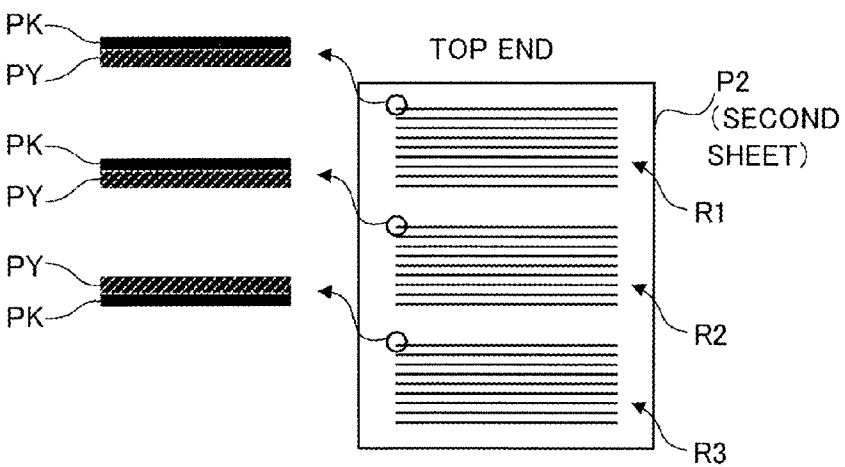
Figure 14A:
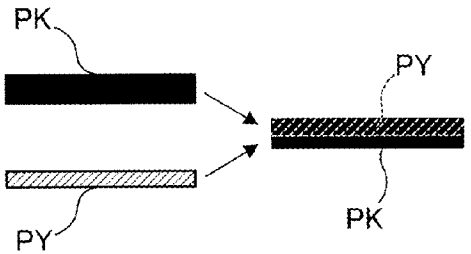
Figure 14C:
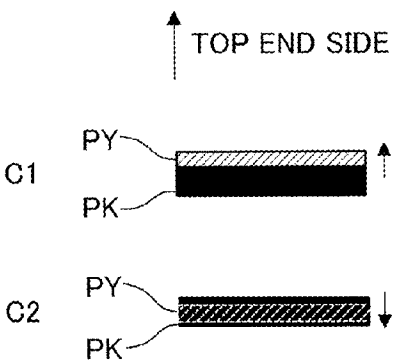

Here, FIGS. 14A to 14C are diagrams showing other forms of the pattern images.

As shown in FIG. 14A, the height (the width in the transport direction of the sheet) of each of the yellow pattern images PY is set smaller than that of each of the black pattern images PK in the present exemplary embodiment. Specifically, the width of the yellow pattern image PY is set narrower than that of the black pattern image PK. Moreover, the yellow pattern image PY is arranged so as to be closer to one edge of the black pattern image PK in the transport direction of the sheet. Specifically, the yellow pattern image PY is arranged so as to be closer to one edge of the black pattern image PK in the width direction. To be more specific, these pattern images PY and PK are arranged in a way that the edge of the black pattern image PK in the transport direction of the sheet coincides with the edge of the yellow pattern image PY in the transport direction of the sheet.

To be more specific, with reference to FIG. 14B, when the pattern images PK and PY are formed on the second region R2 of the first sheet P1, each pattern image PY is arranged so as to be closer to one edge of the corresponding black pattern image PK at the bottom end side of the sheet. In addition, on the third region R3 of the first sheet P1, each pattern image PY is arranged so as to be closer to one edge of the corresponding black pattern image PK at the top end side of the sheet.

Furthermore, on the first region R1 of the second sheet P2, each pattern image PY is arranged so as to be closer to one edge of the corresponding black pattern image PK at the bottom end side of the sheet. On the second region R2 of the second sheet P2, each pattern image PY is arranged so as to be closer to one edge of the corresponding black pattern image PK at the bottom end side of the sheet. Moreover, on the third region R3 of the second sheet P2, each pattern image PY is arranged so as to be closer to one edge of the corresponding black pattern image PK at the top end side of the sheet.

Here, in a case where the speed of one of the photoconductive drums 12Y and 12K changes when the pattern images PY and PK formed at the third region R3 on the second sheet P2 are transferred onto the intermediate transfer belt 20, for example, the transfer position of the pattern image PY may be displaced to a lower position than the original transfer position in some cases, as shown by reference numeral C2 in FIG. 14C. In this case, if the pattern images shown in FIG. 10A are employed, the yellow pattern image PY appears. Specifically, the yellow pattern image PY appears regardless of the rotation speed of the registration rolls 42.

However, with the pattern images of this aspect, since the pattern image PY is arranged so as to be closer to the one edge of the black pattern image PK, so that even if the original transfer position of the pattern image PY is shifted, the pattern image PY do not appear as shown by C2 in FIG. 14C. In other words, the state in which the yellow pattern image PY and the black pattern image PK are overlapped with each other is kept and the color appearance does not change. More specifically, the yellow pattern image PY is prevented from appearing due to a change in the speed of one of the photoconductive drums 12Y and 12K.

On the other hand, in a case where the rotation speed of the registration rolls 42 is higher than a speed set in advance, the yellow pattern image PY is positioned closer to the top end side of the sheet than the black pattern image PK, the yellow color becomes visible in the white ground as shown by C1 in FIG. 14C. In other words, the color appearance changes. Thus, the state in which the rotation speed of the registration rolls 42 is higher may be recognized.

Note that, it is also conceivable to arrange the yellow pattern image PY on the third region R3 of the second sheet P2 in a way that each yellow pattern image PY is arranged so as to be closer to the edge of the corresponding black pattern image PK at the bottom end side of the sheet, for example. In this case, however, there may occur a situation where the yellow pattern image PY does not appear even if the transfer position of the yellow pattern image PY moves to the top end side of the sheet because the rotation speed of the registration rolls 42 is high. That is, even if the position of the pattern image PY is displaced due to the rotation speed of the registration rolls 42, the pattern images PY and PK are kept in a state where they are overlapped with each other, and thus, the pattern image PY does not appear. For this reason, in the present exemplary embodiment, the pattern image PY is arranged at a position closer to a side to which the position thereof is expected to be displaced. To be more specific, in a case where the pattern image PY is displaced in the third region R3 of the second sheet P2 due to the registration rolls 42, the pattern image PY is displaced to the top end side of the sheet (refer to FIG. 11A). For this reason, the pattern image PY is arranged on the third region R3 of the second sheet P2 in a way that each pattern image PY is arranged so as to be closer to the edge of the corresponding pattern image PK at the top end side of the sheet.

Furthermore, when color misregistration occurs in the third region R3 of the first sheet P1 due to the registration rolls 42, for example, the yellow pattern image PY is positioned closer to the top end side of the sheet than the black pattern image as shown in FIG. 11A. For this reason, on the third region R3 of the first sheet P1, the pattern image PY is arranged so as to be closer to the edge of the pattern image PK at the top end side of the sheet as shown in FIG. 14B.

In addition, when color misregistration occurs in the second region R2 of the second sheet P2 due to the registration rolls 42, for example, the yellow pattern image PY is positioned closer to the bottom end side of the sheet than the black pattern image as shown in FIG. 11C. For this reason, on the second region R2 of the second sheet P2, the pattern image PY is arranged so as to be closer to the edge of the pattern image PK on the bottom end side of the sheet as shown in FIG. 14B.

Incidentally, although the descriptions have been given of the case where the positions of toner images are displaced due to the registration rolls 42, color misregistration also occurs due to the fixing device 45 (refer to FIG. 1).

Here, FIGS. 15A and 15B, 16, 17A and 17B, 18A and 18B and 19 are diagrams for explaining color misregistration that occurs due to the fixing device 45.

Figure 15A:
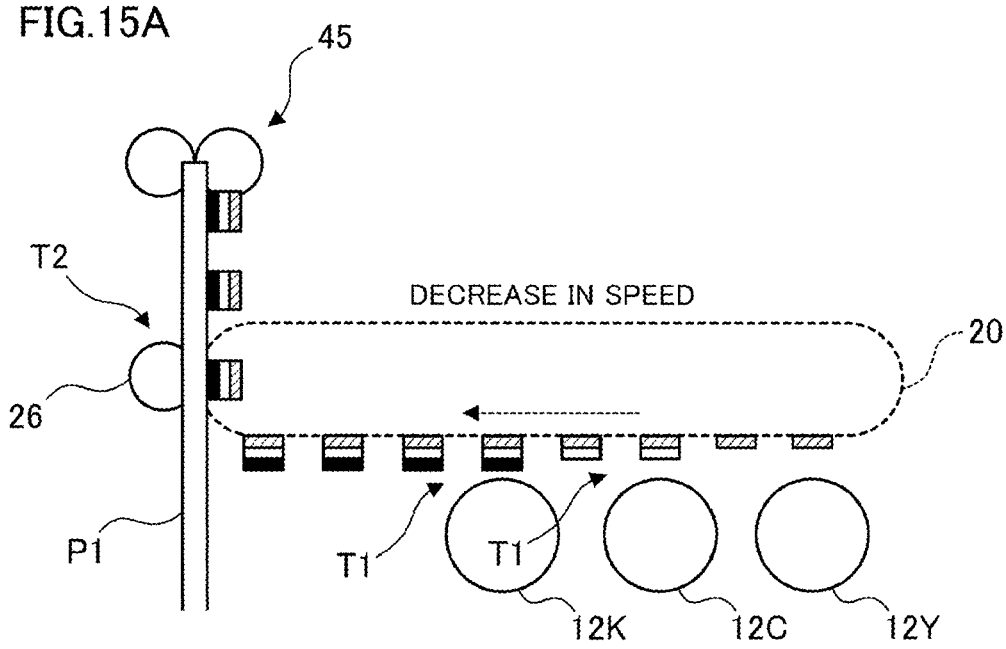
FIGS. 15A and 15B are diagrams for explaining color misregistration that occurs due to the fixing device.
Figure 15B:
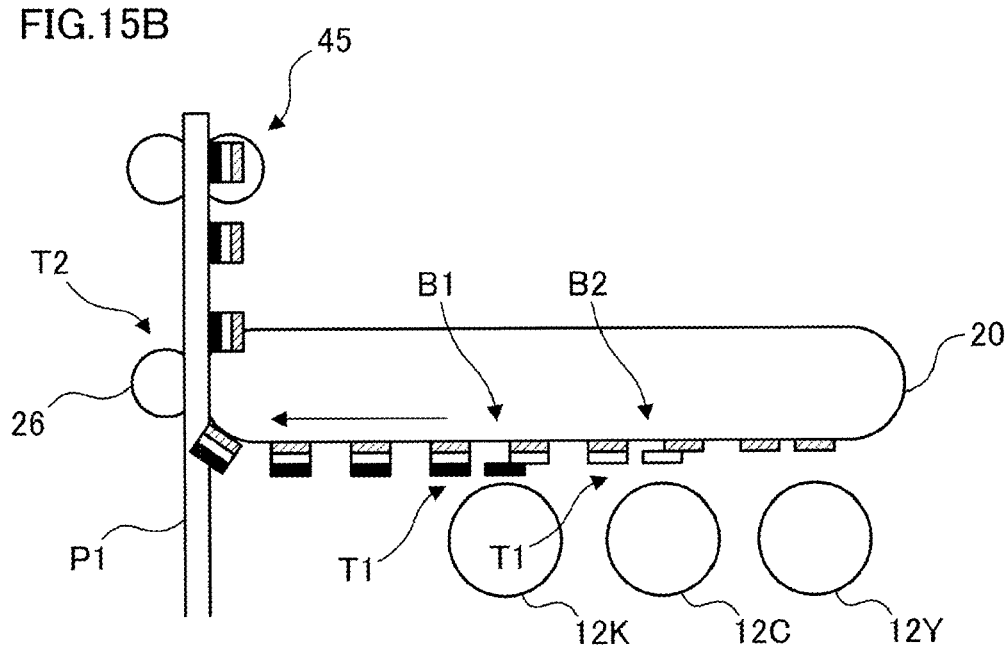
Figure 16:
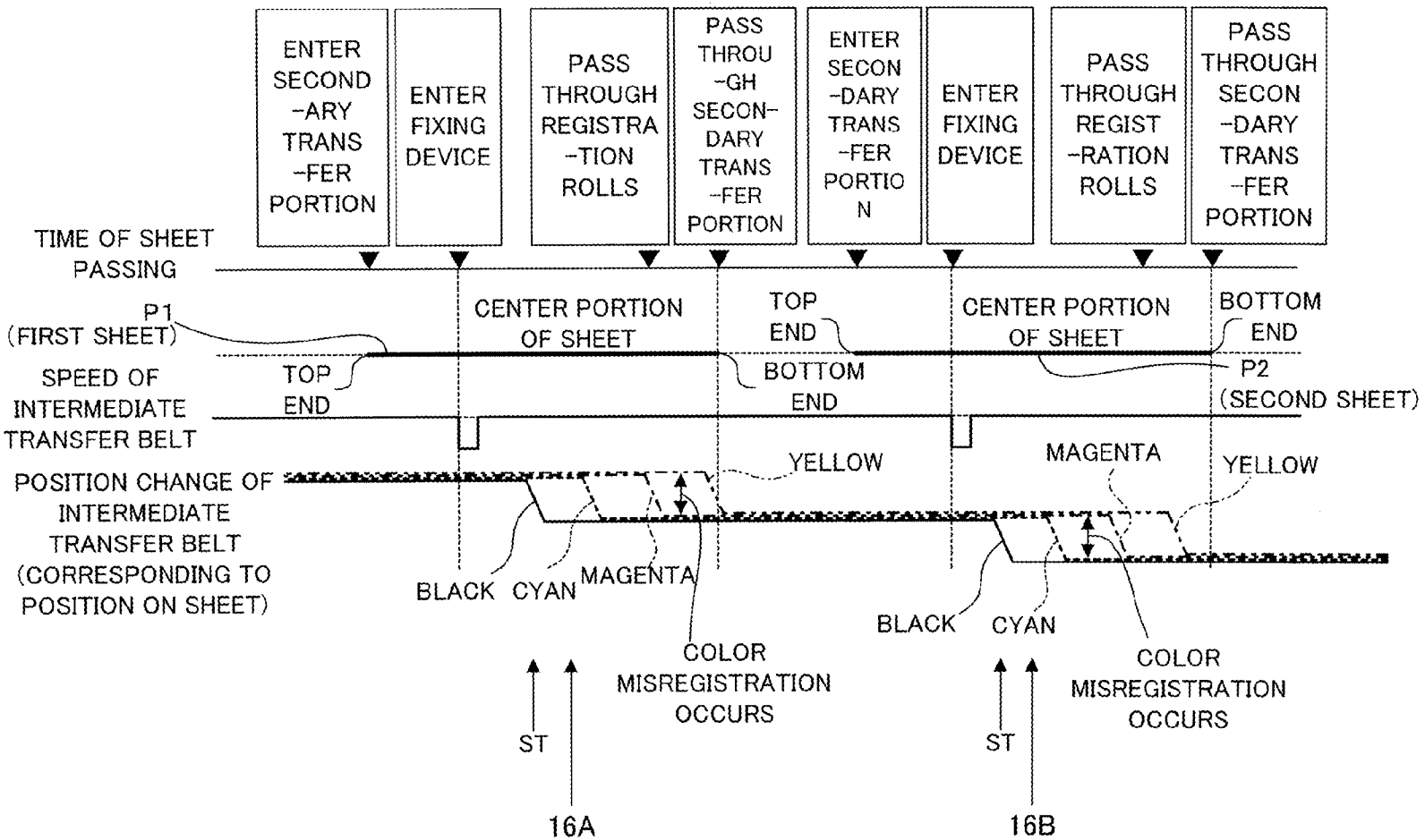
FIG. 16 is a diagram for explaining color misregistration that occurs due to the fixing device.

Note that, FIGS. 15A and 15B and 16 are diagrams for explaining color misregistration occurring when the transport speed of the sheet P transported by the fixing device 45 is lower than the moving speed of the intermediate transfer belt 20. In addition, FIGS. 17A and 17B, 18A and 18B and 19 are diagrams for explaining color misregistration occurring when the transport speed of the sheet P transported by the fixing device 45 is higher than the moving speed of the intermediate transfer belt 20.

In a case where the transport speed of the sheet P transported by the fixing device 45 is lower than the moving speed of the intermediate transfer belt 20 (the rotation speed of the fixing roll 451 (refer to FIG. 1) of the fixing device 45 is lower than a rotation speed set in advance), as shown in FIG. 15A, the transport speed (moving speed) of the first sheet P1 decreases when the first sheet P1 enters the fixing device 45. Then, because of the decrease in the transport speed, the moving speed of the intermediate transfer belt 20 temporarily decreases as shown by a broken line in FIG. 15A.

Thereafter, as shown by a solid line in FIG. 15B, the moving speed of the intermediate transfer belt 20 returns to the speed set in advance. However, the toner images influenced by the decrease in the speed of the intermediate transfer belt 20 arrive at the respective primary transfer portions T1 with delay. As a result, as shown by an arrow B1 in FIG. 15B, the black toner image is positioned at the downstream side in the moving direction of the intermediate transfer belt 20 as compared to the cyan toner image and the like, hence causing color misregistration. Moreover, as shown by an arrow B2, the cyan toner image is positioned at the downstream side in the moving direction of the intermediate transfer belt 20 as compared to the yellow toner image, hence causing color misregistration. In other words, in a case where the transport speed of the sheet P transported by the fixing device 45 is lower than the moving speed of the intermediate transfer belt 20, the color misregistration occurs in the toner images transferred onto the sheet P as in the case where the rotation speed of the registration rolls 42 is low.

Here, FIG. 16 is a diagram showing a summary of the states of color misregistration occurring when the transport speed of the sheet P transported by the fixing device 45 is lower than a speed set in advance.

As shown in FIG. 16, when the top end of the first sheet P1 enters the fixing device 45, the moving speed of the intermediate transfer belt 20 temporarily decreases. Then, because of this decrease in the speed, the black toner image is positioned closer to the top end of the sheet than the other color (cyan, magenta and yellow) toner images, so that color misregistration occurs at the center of the center portion of the sheet P1. In addition, the black and cyan toner images are positioned closer to the top end side of the sheet than the other color (magenta and yellow) toner images, so that color misregistration occurs at the bottom end side of the sheet in the center portion of the sheet P1. In addition, the black, cyan and magenta toner images are positioned closer to the top end side of the sheet than the other color (yellow) toner image, so that color misregistration occurs at the bottom end side of the sheet P1. Moreover, the same color misregistration as those occurring on the first sheet P1 also occur on the second sheet P2.

Note that, when color misregistration occurs due to the fixing device 45, the position at which the color misregistration starts to occur on the sheet P is displaced so as to be closer to the bottom end of the sheet than the position at which color misregistration due to the registration rolls 42 starts to occur. In other words, when the position at which the color misregistration starts to occur due to the registration rolls 42 is denoted as color misregistration occurrence start position SR (refer to FIG. 4), color misregistration occurrence start position ST (refer to FIG. 16), which is the position at which the color misregistration starts to occur due to the fixing device 45, is displaced so as to be closer to the bottom end of the sheet than the color misregistration occurrence start position SR.

Next, descriptions will be given of color misregistration occurring when the transport speed of the sheet P transported by the fixing device 45 is higher than the moving speed of the intermediate transfer belt 20.

Figure 17A:
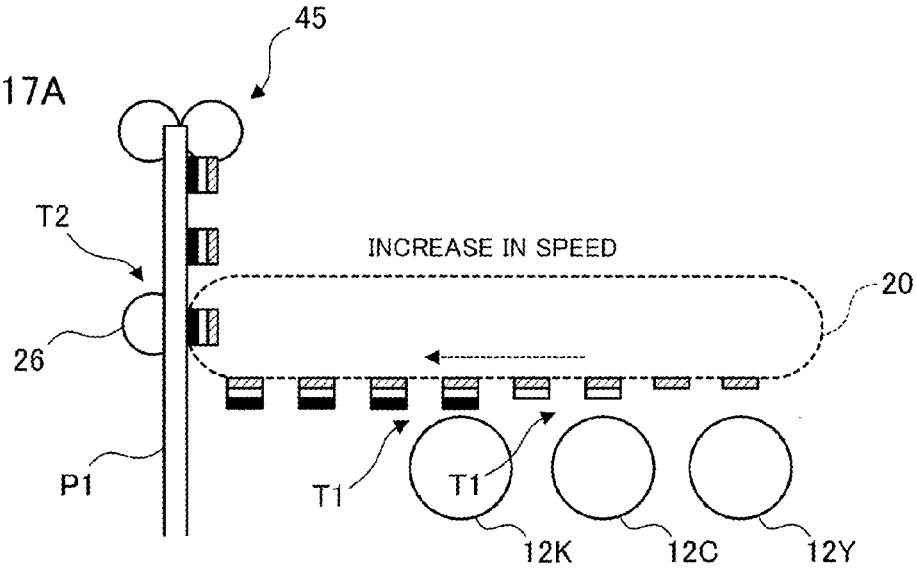
FIGS. 17A and 17B are diagrams for explaining color misregistration that occurs due to the fixing device.

In a case where the transport speed of the sheet P transported by the fixing device 45 is higher than the moving speed of the intermediate transfer belt 20, as shown in FIG. 17A, the first sheet P1 is pulled by the fixing device 45 when the top end of the first sheet P1 enters the fixing device 45. Thereby, the moving speed of the intermediate transfer belt 20 increases as shown by a broken line in FIG. 17A. Because of this increase in the speed, the color toner images on the intermediate transfer belt 20 proceed to positions closer to the downstream side in the moving direction than planned positions.

Figure 17B:
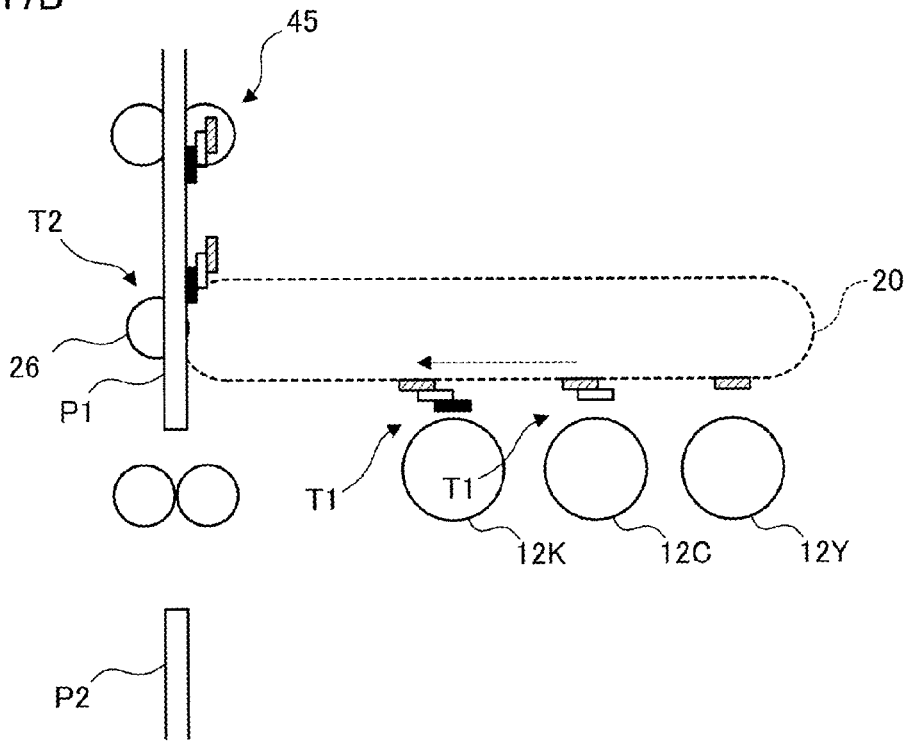

As a result of this, as shown in FIG. 17B, the yellow toner image advances by the largest distance, followed by the cyan toner image on the sheet P1. In addition, among the toner images to be transferred onto the top end portion of the second sheet P2 as well, the yellow toner image advances by the largest distance, followed by the cyan toner image on the sheet P2.

Figure 18A:
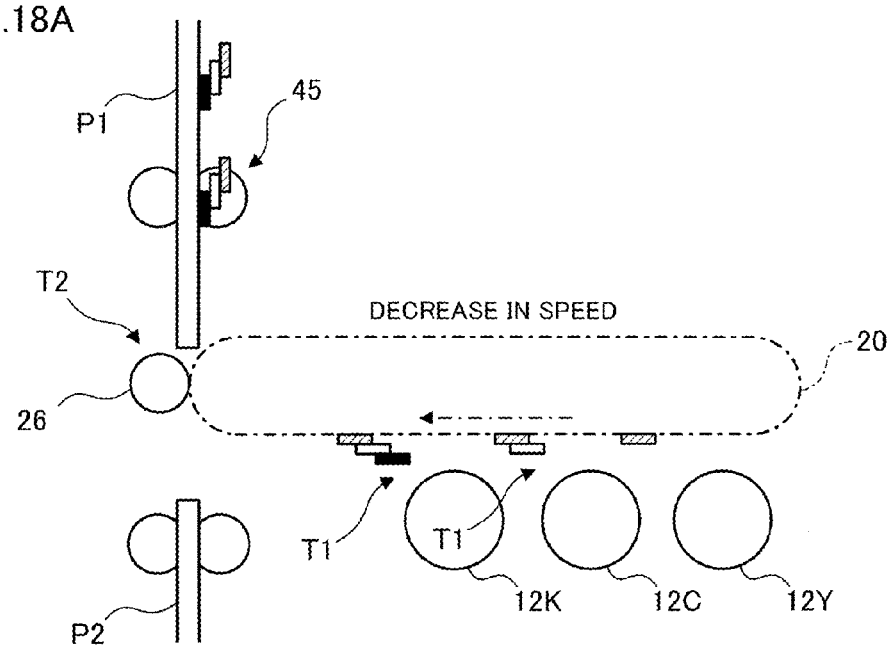
FIGS. 18A and 18B are diagrams for explaining color misregistration that occurs due to the fixing device.

Then, as shown in FIG. 18A, after the bottom end of the first sheet P1 passes through the secondary transfer portion T2, the speed of the intermediate transfer belt 20 temporarily decreases as shown by a dot-dash line in FIG. 18A. Then, the cyan and yellow toner images transferred onto the intermediate transfer belt 20 for the second sheet P2 are influenced by this decrease in the speed. In other words, timings at which the cyan and yellow toner images arrive respectively at the photoconductive drums 12K and 12C are delayed.

Figure 18B:
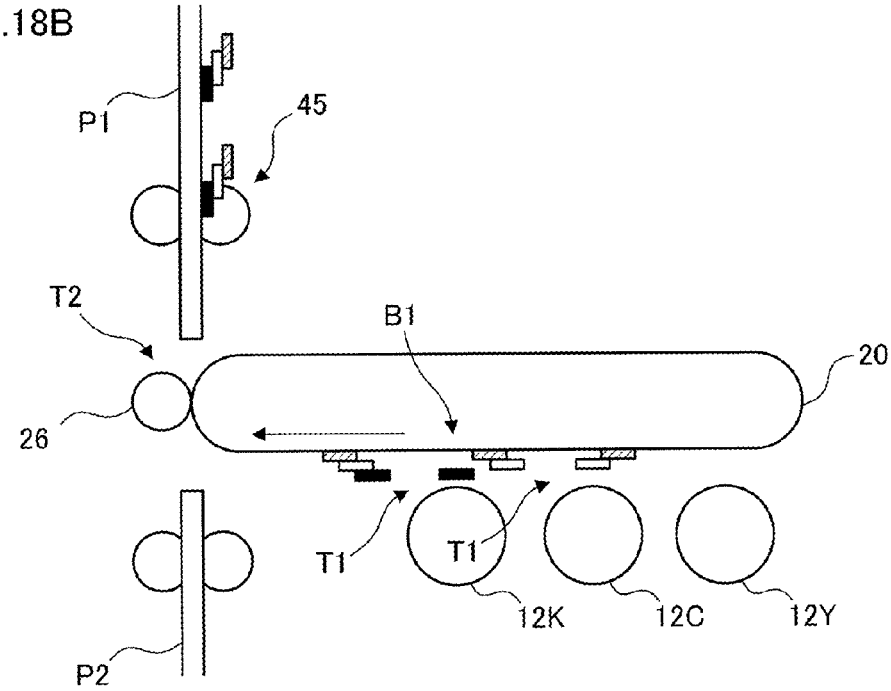

As a result of this, as shown by an arrow B1 in FIG. 18B, the black toner image transferred from the photoconductive drum 12K advances by the largest distance, and the cyan toner image arrives with the largest delay, so that color misregistration occurs between the black toner image and the cyan toner image. Then, the toner images between which the color misregistration occurs are transferred onto the top end portion of the second sheet P2.

Figure 19:
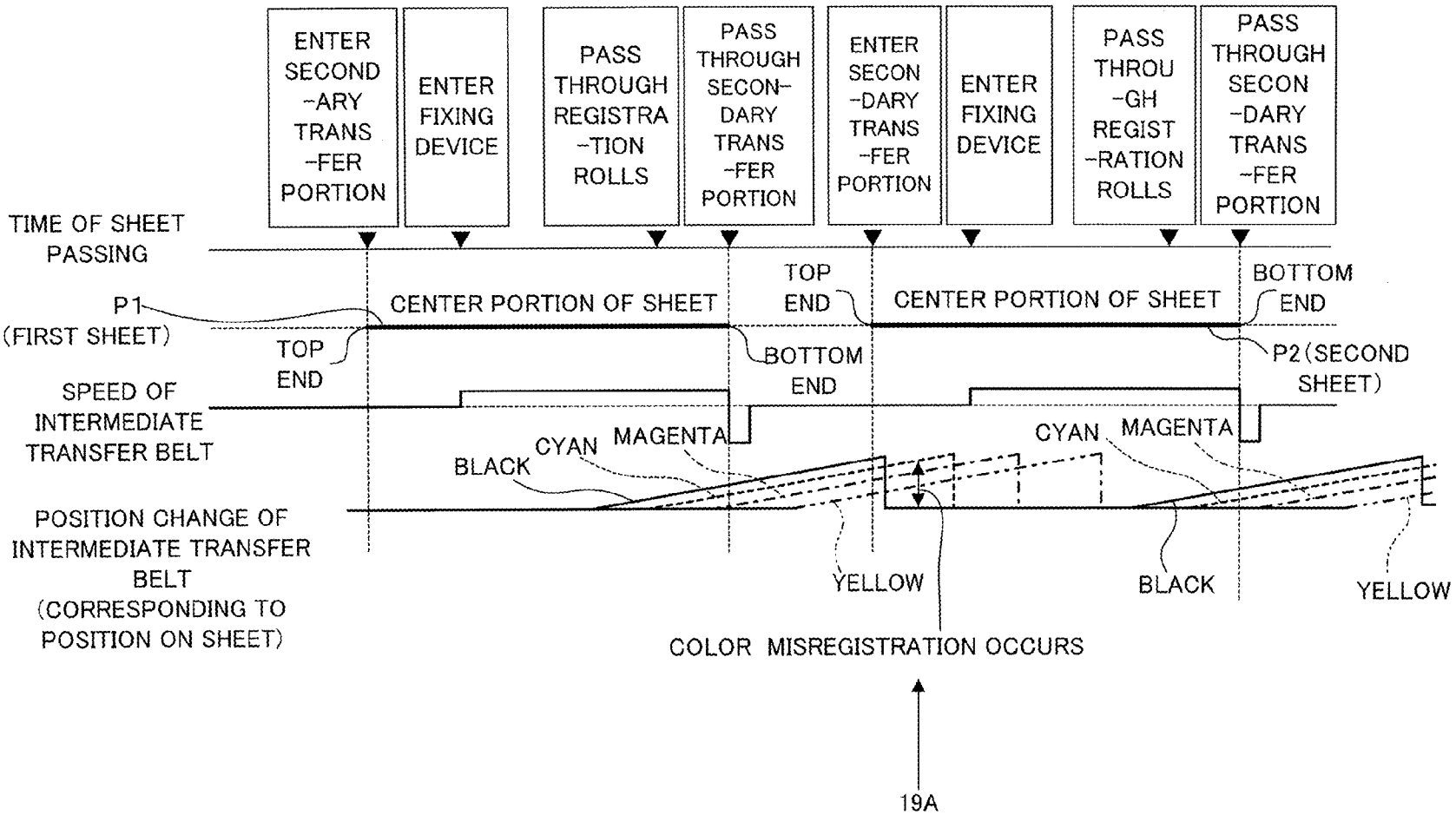
FIG. 19 is a diagram for explaining color misregistration that occurs due to the fixing device.

Here, FIG. 19 is a diagram showing a summary of the states of color misregistration occurring when the transport speed of the sheet P transported by the fixing device 45 is higher than a speed set in advance.

As shown in FIG. 19, when the top end of the first sheet P1 enters the fixing device 45, the moving speed of the intermediate transfer belt 20 increases. Moreover, after the bottom end of the sheet P1 passes through the secondary transfer portion T2, the moving speed of the intermediate transfer belt 20 temporarily decreases. Due to the decrease in the speed, as shown by an arrow 19A and as described above, a large amount of color misregistration that is visually recognizable occurs due to displacement of the positions of the black toner image and the cyan toner image at the top end portion of the second sheet P2.

Here, for determining whether the transport speed of the sheet P in the fixing device 45 is high or low, the same processing as the one shown in FIG. 13 is executed. Then, the transport speed of the sheet P transported by the fixing device 45 is changed. To be more specific, the number of rotations of the first motor M1 (refer to FIG. 1) is set to a new number of rotations. Note that, for determining the transport speed of the sheet P transported by the fixing device 45, a cyan pattern image PC and a black pattern image PK are formed on the sheet P by use of the image forming unit 11C and the image forming unit 11K, respectively. To be more specific, the cyan pattern image PC and the black pattern image PK are formed on the sheet P in the aforementioned step 101 (refer to FIG. 13).

Figures 20A, 20B, 20C:
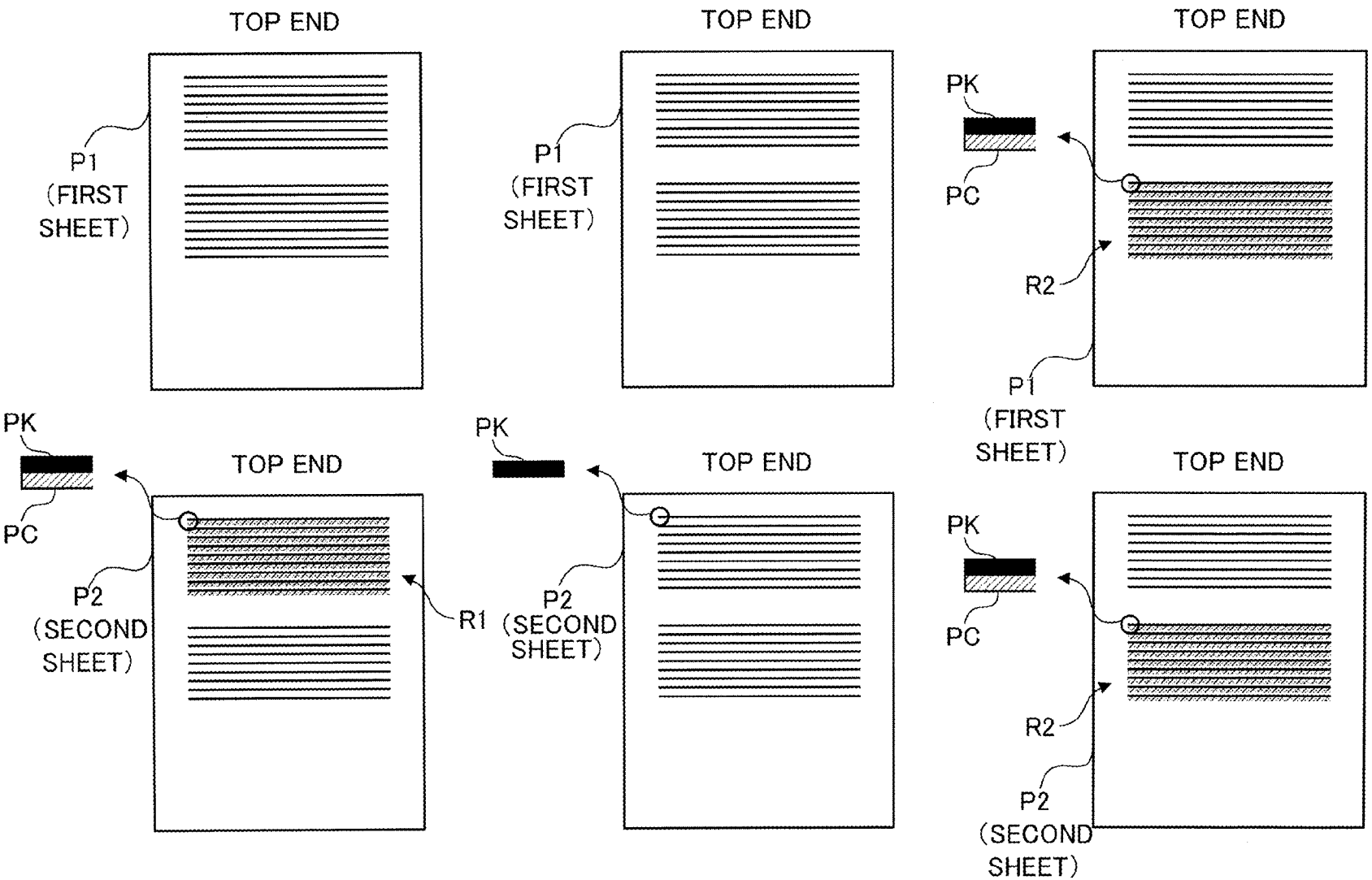
FIGS. 20A to 20C are diagrams showing pattern images formed on the sheets.

Here, FIGS. 20A to 20C are diagrams showing pattern images formed on the sheets P.

For example, when the transport speed of the sheet P at the fixing device 45 is high, color misregistration occurs between the black toner image and the cyan toner image at the top end portion of the second sheet P2 as shown by an arrow 19A in FIG. 19. For this reason, when the cyan pattern image PC and the black pattern image PK are formed on the sheet P, color misregistration occurs in the first region R1 (top end portion of the sheet P2) of the second sheet P2, as shown in FIG. 20A. Thus, the cyan pattern image PC becomes visible.

Note that, when the rotation speed of the registration rolls 42 is different from a rotation speed set in advance, color misregistration occurs between the cyan pattern image PC and the black pattern image PK as well. However, the position at which the color misregistration occurs due to the rotation speed of the registration rolls 42 is different from the position at which the color misregistration occurs due to the fixing device 45. For example, when the rotation speed of the registration rolls 42 is low, the color misregistration occurs at a position closer to the bottom end side of the sheet (refer to the arrow 4C in FIG. 4). Accordingly, when the color misregistration occurs between the cyan pattern image PC and the black pattern image PK at the top end portion of the second sheet P2, it may be determined that the transport speed of the sheet P at the fixing device 45 is high.

Moreover, when the transport speed of the sheet P at the fixing device 45 is low, color misregistration occurs between the black toner image and the cyan toner image in the center portions of the first sheet P1 and the second sheet P2 as shown by arrows 16A and 16B in FIG. 16, respectively. For this reason, when the color misregistration between the black pattern image PK and the cyan pattern image PC occurs on the center portion (second region R2) of the first sheet P1 and the center portion (second region R2) of the second sheet P2 as shown in FIG. 20C, it may be determined that the transport speed of the sheet P at the fixing device 45 is low.

Note that, when the rotation speed of the registration rolls 42 is different from a rotation speed set in advance, color misregistration occurs between the cyan pattern image PC and the black pattern image PK as well. However, the position at which the color misregistration occurs due to the rotation speed of the registration rolls 42 is different from the position at which the color misregistration occurs due to the fixing device 45. For example, when the rotation speed of the registration rolls 42 is low, the color misregistration occurs at a position closer to the top end side of the sheet (refer to the arrows 4C and 4D in FIG. 4). Accordingly, when the cyan pattern image PC is recognizable on the center portion of the sheet P, it may be determined that the transport speed of the sheet P at the fixing device 45 is low.

Furthermore, when the rotation speed of the registration rolls 42 is high, displacement of a position between the black pattern image PK and the cyan pattern image PC occurs at the center portion of the sheet P (refer to the arrow 8D in FIG. 8). However, even if the displacement of a position of this kind occurs, the amount of the displacement is so small that the displacement does not become visually recognizable. For this reason, when the cyan pattern image PC is recognized on the center portion of the sheet P, it may be determined that the transport speed of the sheet P at the fixing device 45 is low.

Note that, when the transport speed of the sheet P at the fixing device 45 is high or low, color misregistration between the black toner image and the cyan toner image occurs at the center portion or the top end portion of the sheet P, and no color misregistration occurs at the bottom end portion of the sheet P, as shown in FIGS. 16 and 19. For this reason, formation of the pattern images on the bottom end portion of the sheet P may be omitted as shown in FIGS. 20A to 20C. In this case, the amount of toner consumption is reduced.

Note that, although the cyan and black pattern images are used for determining the transport speed of the sheet P at the fixing device 45 in the above descriptions, the yellow and black pattern images may be used, as in the case of the registration rolls 42. However, an area in which color misregistration between the black and yellow toner images occurs is wider as described above. As a result, there occurs a situation where it is difficult to judge whether the color misregistration occurring between the black and yellow toner images is due to the fixing device 45 or the registration rolls 42. For this reason, the black pattern image PK and the cyan pattern image PC are used for determining the transport speed of the sheet P at the fixing device 45 because the area in which the color misregistration occur therebetween is the smallest. More specifically, the black image forming unit 11K and the cyan image forming unit 11C, which are adjacent to each other and are most closely related to each other, are used to form the pattern images.

Note that, although the black pattern image is used as one of the two pattern images in the aforementioned exemplary embodiment, a pattern image of a color other than black may be employed. However, when a pattern image other than black is used, a situation where it is difficult to judge whether or not color misregistration exists may occur. For this reason, the black pattern image may be particularly used as one of the two pattern images.

In addition, for determining the transport speed of the sheet P at the fixing device 45, the pattern images described in FIGS. 14A to 14C may be used.

Furthermore, whether or not the transport speed of the sheet P transported by the registration rolls 42 is a speed set in advance, and whether or not the transport speed of the sheet P at the fixing device 45 is a speed set in advance may be determined by outputting the sheet P once.

Figure 21:
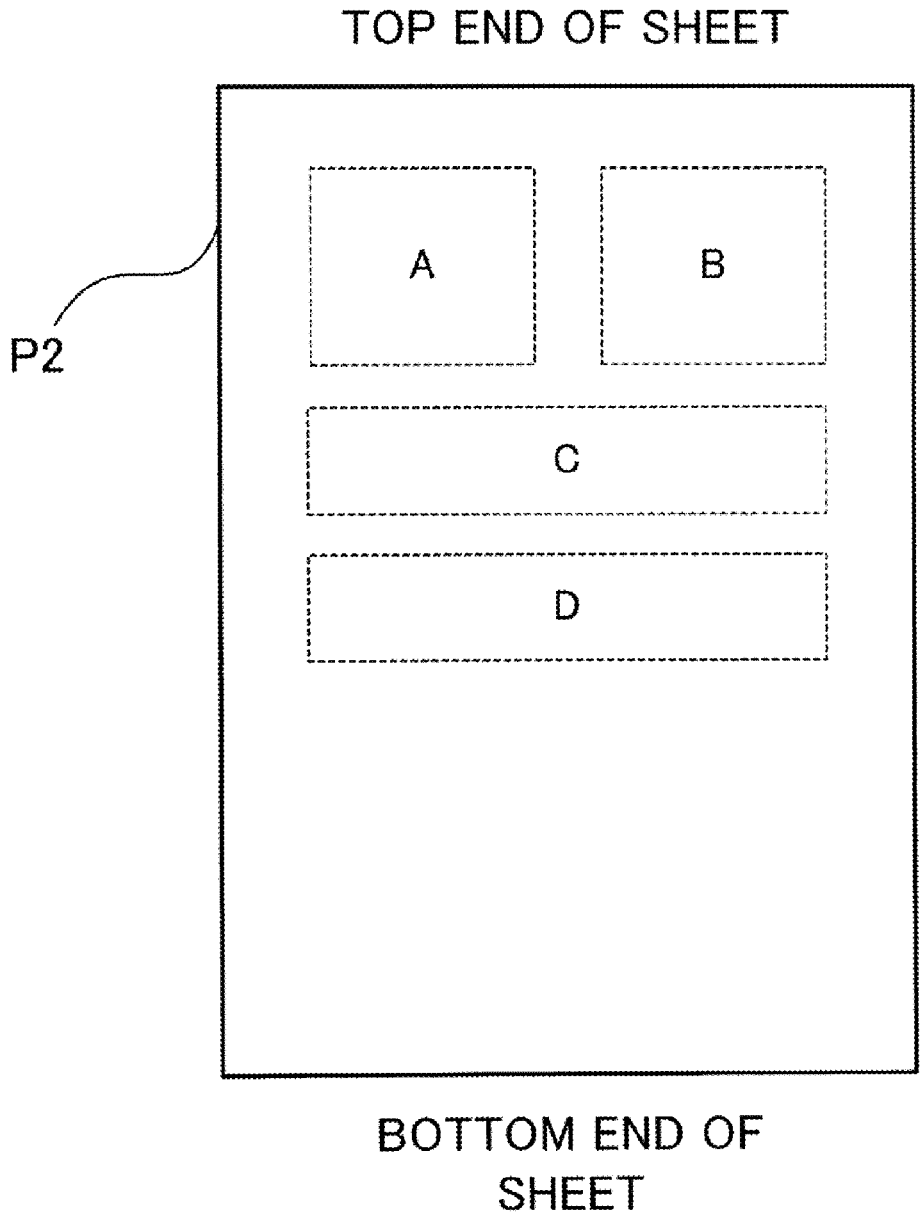
FIG. 21 is a diagram for explaining arrangement regions of pattern images formed on the sheet.

FIG. 21 is a diagram for explaining arrangement regions of pattern images formed on the sheet P.

In a case where the determination is desired to be made by outputting the sheet Ponce, as shown in FIG. 21, the pattern images are formed on regions A and B, which are provided at the top end portion of the second sheet P2 and are adjacent to each other in a direction orthogonal to (intersecting with) the transport direction of the sheet P2. To be more specific, the aforementioned pattern images PK and PC are formed on the region A. The pattern images PK and PY are formed on the region B. In addition, the pattern images PK and PC are formed on a region C, which is the top half portion (top end side of the sheet) of the center portion of the sheet P2. Furthermore, the pattern images PK and PC are formed on a region D, which is the center of the center portion of the sheet P 2.

Here, when the transport speed of the sheet P at the fixing device 45 is low, for example, color misregistration between the black toner image and the cyan toner image occurs at the center of the center portion of the second sheet P2 (refer to FIG. 16). Accordingly, if the cyan pattern image PC is recognized in the region D in FIG. 21, it may be determined that the transport speed of the sheet P at the fixing device 45 is low.

In addition, when the transport speed of the sheet P at the fixing device 45 is high, for example, color misregistration between the black toner image and the cyan toner image occurs at the top end portion of the second sheet P2 (refer to FIG. 19). Accordingly, if the cyan pattern image PC is recognized in the region A in FIG. 21, it may be determined that the transport speed of the sheet P at the fixing device 45 is high.

In addition, when the transport speed of the sheet P transported by the registration rolls 42 is low, color misregistration between the black toner image and the cyan toner image occurs at the top half portion (top end side of the sheet) of the center portion of the second sheet P2 (refer to FIG. 4). Accordingly, if the cyan pattern image PC is recognized in the region C in FIG. 21, it may be determined that the transport speed of the sheet P transported by the registration rolls 42 is low.

Moreover, when the transport speed of the sheet P transported by the registration rolls 42 is high, color misregistration between the black toner image and the yellow toner image occurs at the top end portion of the second sheet P2 (refer to FIG. 8). Accordingly, if the yellow pattern image PY is recognized in the region B in FIG. 21, it may be determined that the transport speed of the sheet P transported by the registration rolls 42 is high.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder that is movably provided; a first image forming unit that forms a first image on the image holder;

a second image forming unit that forms a second image on the image holder including the first image formed thereon;

a transfer portion that transfers, onto a recording medium, the first image and the second image formed on the image holder;

a supply unit that transports the recording medium and that supplies the recording medium to the transfer portion;

an acquisition unit that acquires information on a position of displacement on the recording medium in a transport direction of the recording medium, the displacement occurring between the first image and the second image transferred onto the recording medium; and an adjustment unit that changes a supply speed of the recording medium at the supply unit on the basis of the information on the position, the information acquired by the acquisition unit.

2. The image forming apparatus according to claim 1, wherein the first image forming unit forms, on the image holder, the first image having a first color and being in a line shape in a direction intersecting with a moving direction of the image holder, and the second image forming unit forms, on the image holder, the second image having a second color different from the first color and being in a line shape in the direction intersecting with the moving direction of the image holder.

3. The image forming apparatus according to claim 2, wherein one of the first image being in the line shape and formed by the first image forming unit and the second image being in the line shape and formed by the second image forming unit is formed so as to have a width narrower than a width of the other one of the first image and the second image, and the one of the first image and the second image is formed at a position substantively close to one edge of the other one of the first image and the second image in a width direction.

4. The image forming apparatus according to claim 1, further comprising:

a plurality of toner image forming units that are arranged side by side in a moving direction of the image holder, and that respectively form toner images on the image holder, wherein the first image forming unit forms the first image by using one of two toner image forming units among the toner image forming units, the two toner image forming units being most distant from each other, and the second image forming unit forms the second image by using the other one of the two toner image forming units.

5. An image forming apparatus comprising:

an image holder that is movably provided; a first image forming unit that forms a first image on the image holder;

a second image forming unit that forms a second image on the image holder including the first image formed thereon;

a transfer portion that transfers, onto a recording medium, the first image and the second image formed on the image holder;

a fixing unit that fixes, on the recording medium, the first image and the second image transferred onto the recording medium while transporting the recording medium;

an acquisition unit that acquires information on a position of displacement on the recording medium in a transport direction of the recording medium, the displacement occurring between the first image and the second image fixed on the recording medium; and an adjustment unit that changes a transport speed of the recording medium at the fixing unit on the basis of the information on the position, the information acquired by the acquisition unit.

6. The image forming apparatus according to claim 5, wherein the acquisition unit acquires the information on the position on the basis of information inputted by a user.

7. The image forming apparatus according to claim 5, wherein the acquisition unit further acquires information on an amount of the displacement between the first image and the second image, and the adjustment unit changes the transport speed on the basis of the information on the position and the information on the amount of the displacement.

8. The image forming apparatus according to claim 5, further comprising:

a supply unit that transports the recording medium and that supplies the recording medium to the transfer portion, wherein the adjustment unit further changes a supply speed of the recording medium at the supply unit on the basis of the information on the position, the information acquired by the acquisition unit.

9. The image forming apparatus according to claim 5, further comprising:

a plurality of toner image forming units that are arranged side by side in a moving direction of the image holder, and that respectively form toner images on the image holder, wherein the first image forming unit forms the first image by using one of two toner image forming units among the toner image forming units, the two toner image forming units being adjacent to each other, and the second image forming unit forms the second image by using the other one of the two toner image forming units.

10. An image forming method of an image forming apparatus including: an image holder that is movably provided; a first image forming unit that forms a first image on the image holder; a second image forming unit that forms a second image on the image holder including the first image formed thereon; a transfer portion that transfers, onto a recording medium, the first image and the second image formed on the image holder; and a supply unit that transports the recording medium and that supplies the recording medium to the transfer portion, the image forming method comprising:

acquiring information on a position of displacement on the recording medium in a transport direction of the recording medium, the displacement occurring between the first image and the second image transferred onto the recording medium; and changing a supply speed of the recording medium at the supply unit on the basis of the information on the position.

* * * * *